US008414847B2

(12) United States Patent
Davis

(10) Patent No.: US 8,414,847 B2
(45) Date of Patent: Apr. 9, 2013

(54) METHOD AND APPARATUS FOR CONTROL OF FLUID TEMPERATURE AND FLOW

(75) Inventor: Scott Davis, Reston, VA (US)

(73) Assignee: Forced Physics, LLC, Irvine, CA (US)

( * ) Notice: Subject to any disclaimer, the term of this patent is extended or adjusted under 35 U.S.C. 154(b) by 406 days.

(21) Appl. No.: 12/585,981

(22) Filed: Sep. 30, 2009

(65) Prior Publication Data

US 2010/0096016 A1 Apr. 22, 2010

Related U.S. Application Data

(60) Provisional application No. 61/101,227, filed on Sep. 30, 2008.

(51) Int. Cl.
*B01L 3/00* (2006.01)

(52) U.S. Cl. ..... 422/502

(58) Field of Classification Search ..... 422/502
See application file for complete search history.

(56) References Cited

U.S. PATENT DOCUMENTS

| | | | | |
|---|---|---|---|---|
| 6,932,564 | B2 | 8/2005 | Davis | |
| 7,008,176 | B2 | 3/2006 | Davis | |
| 7,021,369 | B2 | 4/2006 | Werner et al. | |
| 7,062,929 | B2 | 6/2006 | Nishida et al. | |
| 7,156,159 | B2 | 1/2007 | Lovette et al. | |
| 2002/0176804 | A1 * | 11/2002 | Strand et al. | 422/100 |
| 2010/0038056 | A1 | 2/2010 | Ellsworth et al. | |

FOREIGN PATENT DOCUMENTS

| | | | |
|---|---|---|---|
| GB | 2 250 087 | A | 5/1992 |
| JP | 63 067760 | A | 3/1988 |
| WO | WO 2008/067206 | A2 | 6/2008 |

OTHER PUBLICATIONS

PCT International Search Report for International Appl. No. PCT/US2009/059079 dated Dec. 7, 2010 (5 pages).

PCT Written Opinion and PCT International Search Report for International Appl. No. PCT/US2009/059079 dated Jan. 12, 2011 (14 pages).

E.B. Arkilic, et al. "Slip Flow in MicroChannels," captioned "*To appear in Proceedings of Rarefied Gas Dynamics Symposium*, Oxford UK, Jul. 1994", (downloaded from http://www-mtl.mit.edu/researchgroups/mems/people/schmidt/conferences/28.ArkilicRGDJuly94.pdf) (7 pages).

J. Jang, et al. "Pressure Distributions and TMAC Measurements in Near Unity Aspect Ratio, Anodically Bonded Microchannels," in *Proc. IEEE Sixteenth Annual International Conference on Micro Electro Mechanical Systems*, Kyoto, Japan, Jan. 19-23, 2003, pp. 287-290 (4 pages).

J. Jang, et al. "Gaseous slip flow analysis of a micromachined flow sensor for ultra small flow applications," in *J. Micromechanics & Microengineering*, vol. 17, No. 2, Feb. 2007 (Bristol, UK) pp. 229-237 (9 pages).

(Continued)

*Primary Examiner* — Lore Jarrett
(74) *Attorney, Agent, or Firm* — Finnegan, Henderson, Farabow, Garrett & Dunner, L.L.P.

(57) ABSTRACT

Materials, components, and methods consistent with the present invention are directed to the fabrication and use of micro-scale channels with a fluid, where the temperature and flow of the fluid is controlled through the geometry of the micro-scale channel and the configuration of at least a portion of the wall of the micro-scale channel and the constituent particles that make up the fluid. Moreover, the wall of the micro-scale channel and the constituent particles are configured such that collisions between the constituent particles and the wall are substantially specular.

53 Claims, 18 Drawing Sheets

OTHER PUBLICATIONS

C.-Y. Huang, et al. "PSP Measurement in Microchannel Flow," in *2005 21st International Congress on Instrumentation in Aerospace Simulation Facilities*, ICIASF '05, Sendai Japan, Aug. 29-Sep. 1, 2005, pp. 226-233 (8 pages).

J. Jang, et al. "Effective heights and tangential momentum accommodation coefficients of gaseous slip flows in deep reactive ion etching rectangular microchannels," in *J. Micromechanics & Microengineering*, vol. 16, No. 3, Mar. 2006 (Bristol, UK) pp. 493-504 (12 pages).

E.B. Arkilic, et al. "Mass flow and tangential momentum accommodation in silicon micromachined channels," in *J. Fluid Mech*., vol. 437, 2001 (Cambridge, UK) pp. 29-43 (15 pages).

A, Agrawal, et al. "Survey on measurement of tangential momentum accommodation coefficient," J. Vac. Sci. Technol. A, vol. 26, No. 5, Jul./Aug. 2008, pp. 634-645 (12 pages).

T. Gombosi, Gaskinetic theory, Cambridge University Press 1994 (Cambridge, UK) (311 pages).

Perry's Chemical Engineers' Handbook, 8th Edition, McGraw-Hill 2008 (New York) pp. 2-212-2-213 (4 pages).

T.M. Flynn, "Cryogenic Engineering," 2nd Edition, CRC Press, 2005 (Louisville, CO) p. 639. (3 pages).

"DuPont(TM) ISCEON(R) MO59 and DuPont(TM) ISCEON(R) MO79 Properties, Uses Storage, and Handling" from "DuPont(TM) ISCEON(R) 9 Series Refrigerants Technical Information," (2005) (downloaded from http://www2.dupont.com/Refrigerants/en_US/assets/downloads/k10927_ISCEON_MO59_MO79_push.pdf) (16 pages).

"Thermodynamic Properties of DuPont(TM) Freon(R) (R-22)," "DuPont(TM) Freon(R) Refrigerants Technical Information T-22 SI," (2005) (downloaded from http://www2.dupont.com/Refrigerants/en_US/assets/downloads/k05736_Freon22_thermo_prop.pdf) (20 pages).

R.W. Barber, et al., "Rarefied Gas Dynamics in Micro-Devices," (dated Nov. 8, 2007 by "Internet Archive Wayback Machine," from http://www.cse.scitech.ac.uk/ceg/rgd.shtml) (7 pages).

R.W. Barber, et al. "Challenges in Modeling Gas-Phase Flow in Microchannels: From Slip to Transition," Heat Transfer Engineering, vol. 27, No. 4, pp. 3-12 (2006) (10 pages).

G.A. Bird, "Molecular Gas Dynamics and the Directr Simulation of Gas Flows," Oxford University Press, 1994 (Oxford, UK) pp. 1-6 (8 pages).

International Search Report in International Application No. PCT/US2011/037369 from the International Searching Authority with a date of mailing: Sep. 21, 2011 (4 pages total).

* cited by examiner

METHOD AND APPARATUS FOR CONTROL OF FLUID TEMPERATURE AND FLOW

This application claims priority to U.S. Provisional Application No. 61/101,227, filed Sep. 30, 2008, the contents of which are incorporated herein by reference.

FIELD OF THE INVENTION

Materials, components, and methods consistent with the present invention are directed to the fabrication and use of micro-scale channels with a fluid, where the temperature and flow of the fluid is at least partially controlled through the geometry of the channel and the configuration of at least a portion of the wall of the channel and the constituent particles that make up the fluid.

BACKGROUND OF THE INVENTION

A volume of fluid, such as air, may be characterized by a temperature and pressure. When considered as a collection of constituent particles, comprising, for example, molecules of oxygen and nitrogen, the volume of fluid at a given temperature may also be characterized as a distribution of constituent particle speeds. This distribution may characterized, generally, by an average speed which is understood to bear a relationship with the temperature of the fluid (as a gas).

Accordingly, the internal thermal energy of a fluid provides a source of energy for applications related to heating, cooling, and the generation of fluid flow. One manner of exploiting the internal thermal energy of a fluid, such as a gas, has been described in U.S. Pat. Nos. 7,008,176 and 6,932,564, herein fully incorporated by reference.

Where the device for exploiting the internal thermal energy of a fluid, such as a gas, operates by selecting the constituent particles of the fluid based upon the use of moving parts to select the particles direction of movement or its velocity, there exists a need for a method and device that can control fluid flow and temperature, but that is not based upon such moving parts.

It is accordingly a primary object of the invention to provide a solution for systems and methods that benefit from cooling, heating, and/or flow control of a fluid but that operate upon principles that do not rely upon moving parts.

This is achieved by the manufacture and use of systems that utilize one or more micro-scale channels (a "micro channel") that are configured to accommodate the flow of a fluid, and where the walls of the micro channel and the constituent particles in the fluid are configured such that collisions between the constituent particles and the walls of the micro channel are substantially specular.

SUMMARY OF THE INVENTION

An exemplary micro channel consistent with the present invention is configured with an inflow opening and an outflow opening—which are in fluid communication with each other.

As used herein the "cross-section" of a micro channel refers to a characteristic area of the micro channel that is substantially perpendicular to the direction defined by the general flow of a fluid through the micro channel.

As used herein the "throat" of a micro channel refers to that portion of the micro channel which exhibits a local minima in its cross-section. Note that there may be multiple throats associated with one micro channel.

In one embodiment consistent with the present invention, the inflow opening of a micro channel is configured to be the throat of the micro channel, and the walls of the micro channel are configured to present a micro channel with a generally continuously increasing cross section along the direction of flow of the fluid. In such an exemplary embodiment, (where, for example the fluid is air) the inflow opening is preferably 100 μm^2 and may be anywhere in the range 0.01 μm^2 to 500 μm^2. Moreover, the outflow opening is preferably 3000 μm^2 and may be anywhere in the range 0.1 μm^2 to 50,000 μm^2. The length of the walls of the micro channel (i.e., the linear distance between the inflow opening and the outflow opening of the micro channel) is preferably 30 mm and may be anywhere in the range 0.01 mm to 10 meters. In another embodiment consistent with the present invention, the dimensions of the inflow opening and the outflow opening (and the dimensions of the cross section as a function of length) may be reversed from that just discussed. For example, the inflow opening is preferably 3000 μm^2 and may be anywhere in the range 0.1 μm^2 to 50,000 μm^2, and the outflow opening is preferably 100 μm^2 and may be anywhere in the range 0.01 μm^2 to 500 μm^2.

In another embodiment consistent with the present invention, the inflow opening of a micro channel is configured to be the throat of the micro channel, and the walls of the micro channel are configured to present a micro channel with a sharp increase in the cross section adjacent to the throat, and then a substantially static cross section along the direction of flow of the fluid. In such an exemplary embodiment, (where, for example the fluid is air) the inflow opening is preferably 100 μm^2 and may be anywhere in the range 0.01 μm^2 to 500 μm^2. An exemplary length of such an inflow opening, prior to expanding to a larger, substantially constant, opening, may be approximately 500 μm. Moreover, the outflow opening is preferably 3000 μm^2 and may be anywhere in the range 0.1 μm^2 to 50,000 μm^2. The length of the walls of the micro channel (i.e., the linear distance between the inflow opening and the outflow opening of the micro channel) is preferably 30 mm and may be anywhere in the range 0.01 mm to 50 meters. In another embodiment consistent with the present invention, the dimensions of the inflow opening and the outflow opening (and the dimensions of the cross section as a function of length) may be reversed from that just discussed. For example, the inflow opening is preferably 3000 μm^2 and may be anywhere in the range 0.1 μm^2 to 50,000 μm^2, and the outflow opening is preferably 100 μm^2 and may be anywhere in the range 0.01 μm^2 to 500 μm^2.

In another embodiment consistent with the present invention, both the inflow opening and the outflow opening of a micro channel are configured to be throats of the micro channel (i.e., present local minima in the cross section), and the walls of the micro channel are configured to present a micro channel with a generally continuously increasing cross section along the direction of flow of the fluid to a maximum point—preferably mid-way between the inflow opening and the outflow opening—and then to present a micro channel with a generally continuously decreasing cross section along the direction of flow of the fluid to a local minimum point at the outflow opening. In such an exemplary embodiment, (where, for example the fluid is air) the inflow opening and the outflow opening are preferably 100 μm^2 and may be anywhere in the range 0.01 μm^2 to 500 μm^2. The maximum of the cross section between the inflow opening and the outflow opening is preferably 3000 μm^2 and may be anywhere in the range 0.1 μm^2 to 50,000 μm^2. The length of the walls of the micro channel (i.e., the linear distance between the inflow opening and the outflow opening of the micro channel) is preferably 30 mm and may be anywhere in the range 0.02 mm to 100 meters.

In yet another embodiment consistent with the present invention, both the inflow opening and the outflow opening of a micro channel are configured to be throats of the micro channel, and the walls of the micro channel are configured present a micro channel with a sharp increase in the cross section adjacent to the throat at the inflow opening, a substantially static cross section along the direction of flow of the fluid, and then a sharp decrease in the cross section adjacent to the throat at the outflow opening. In such an exemplary embodiment, (where, for example the fluid is air) the inflow opening and the outflow opening are preferably 100 μm^2 and may be anywhere in the range 0.01 μm^2 to 500 μm^2. The maximum of the cross section between the inflow opening and the outflow opening is preferably 3000 μm^2 and may be anywhere in the range 0.1 μm^2 to 50,000 μm^2. The length of the walls of the micro channel (i.e., the linear distance between the inflow opening and the outflow opening of the micro channel) is preferably 30 mm and may be anywhere in the range 0.02 mm to 100 meters. An exemplary length of such an inflow opening and outflow opening (prior to their expansion to the larger, substantially constant, cross section), may be approximately 500 μm.

In another embodiment consistent with the present invention, any one of the micro channel segments described above (a first micro channel segment) may be configured to be in fluid communication with another micro channel segment (a second micro channel segment), such as configuring the outflow opening of the first micro channel segment to be direct in fluid communication with the inflow opening of a second micro channel segment. Moreover, the first micro channel segment and the second micro channel segment may be configured to present cross sections that exhibit similar or substantially similar walls shapes and dimensions as a function of length of the micro channel, and similar or substantially similar throat dimensions.

Further still, in another embodiment consistent with the present invention, any one of the micro channel segments described above (a first micro channel segment) may be configured to present a micro channel that is substantially parallel to another micro channel segment (a second micro channel segment), such as configuring the inflow openings of the first micro channel segment and the second micro channel segment to be in fluid communication with each other, and the outflow openings of the first micro channel segment and the second micro channel segment to be in fluid communication with each other. Moreover, the first micro channel segment and the second micro channel segment may be configured to present cross sections that exhibit similar or substantially similar walls shapes and dimensions as a function of length of the micro channel, and similar or substantially similar throat dimensions.

In addition, the manipulation of the flow and temperature of a volume of fluid, where the fluid comprises molecules, allows for the population of molecular vibrational through the enhanced heating of a volume of a fluid. Where such vibrationally-excited molecules are allowed to relax, then methods and systems consistent with the present invention allow for the creation and manipulation of electromagnetic radiation emitted thereby.

Further still, the manipulation of the flow and temperature of a volume of fluid, provides for an abundance of practical applications ranging from heating and cooling, refrigeration, electricity generation, coherent and non-coherent light emission, gas pumping, plasma and particle beam production, particle beam acceleration, chemical processes, and others.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate an embodiment of the invention and together with the description, serve to explain the principles of the invention.

DESCRIPTION OF THE EMBODIMENTS

Reference will now be made in detail to the present embodiment (exemplary embodiment) of the invention, characteristics of which are illustrated in the accompanying drawings. Wherever possible, the same reference numbers will be used throughout the drawings to refer to the same or like parts.

Figure 1:
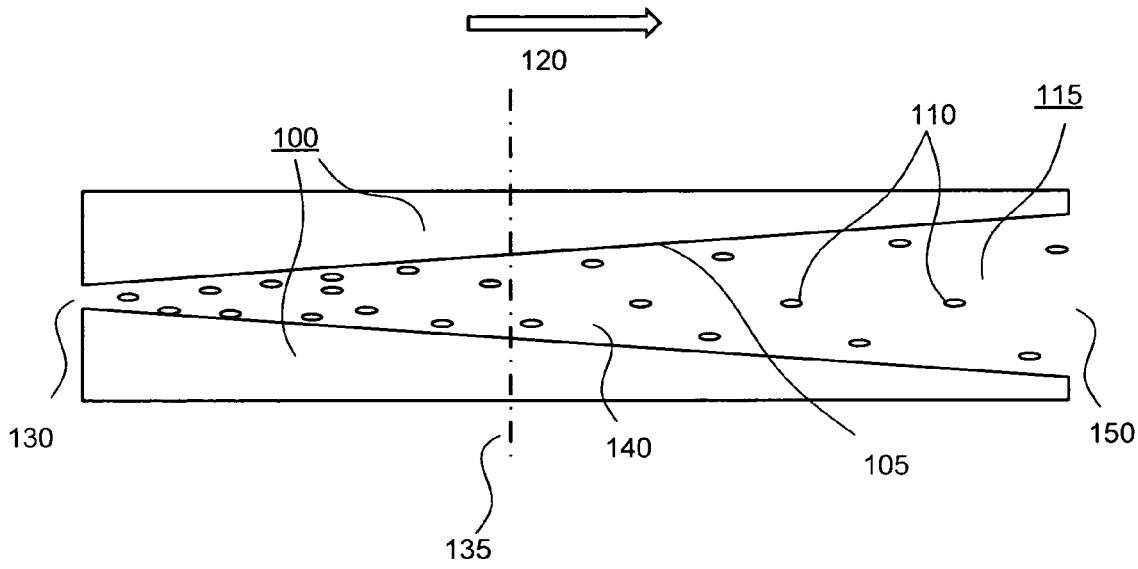
FIG. 1 is view of a cross section of one embodiment consistent with the present invention.
Figure 2:
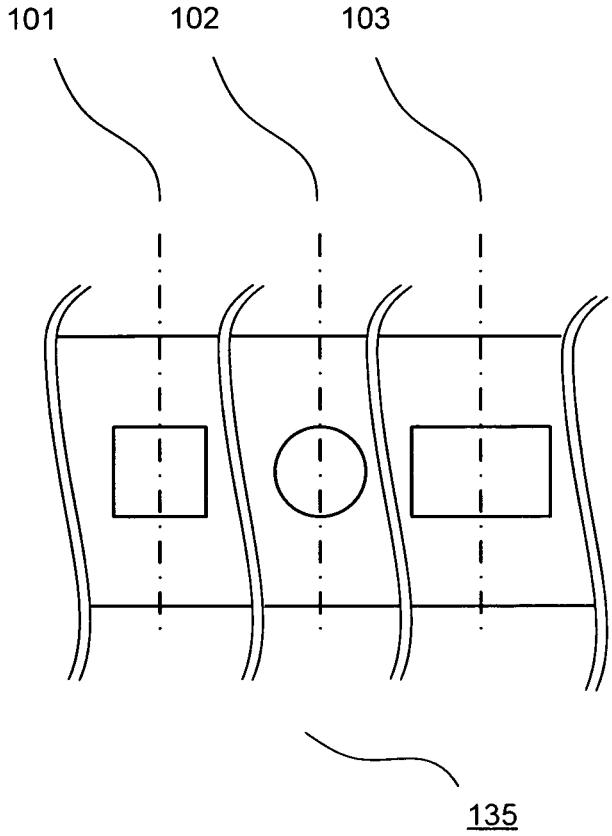
FIG. 2 is alternative view of three cross sectional shapes consistent with the present invention and the embodiments depicted, for example, in FIGS. 1, 4, 5, and 6.

FIG. 1 depicts a view of an exemplary embodiment consistent with the present invention. Micro channel 100 includes inflow opening 130 and outflow opening 150. Fluid 115, comprising constituent particles 110, flows through micro channel 100 in direction 120. Wall 105 of micro channel 100 is proximal to the flow of fluid 115. The view associated with FIG. 1 is that of a cross sectional slice of micro channel 100 consistent with the present invention. Other exemplary cross sectional views of micro channel 100 consistent with the present invention are depicted in FIG. 2, and represent exemplary views consistent with slice 135 (shown in FIG. 1). For example the cross section of inflow opening 130, region 140, and outflow opening 150 may be any one of square 101, circle 102, rectangle 103, or any other shape associated with a bounded two-dimensional figure.

Considering FIG. 1 again, the flow of fluid 115 in direction 120 through micro channel 100 may be induced through the use of a pressure differential between inflow opening 130 and outflow opening 150. Moreover, wall 105 and constituent particles 110 are configured such that collisions between constituent particles 110 and wall 105 that are internal in micro channel 100 (where the internal region is represented generally by region 140) are substantially specular. Specular collisions are depicted in an exemplary fashion in FIG. 3 in more detail.

Figure 3:
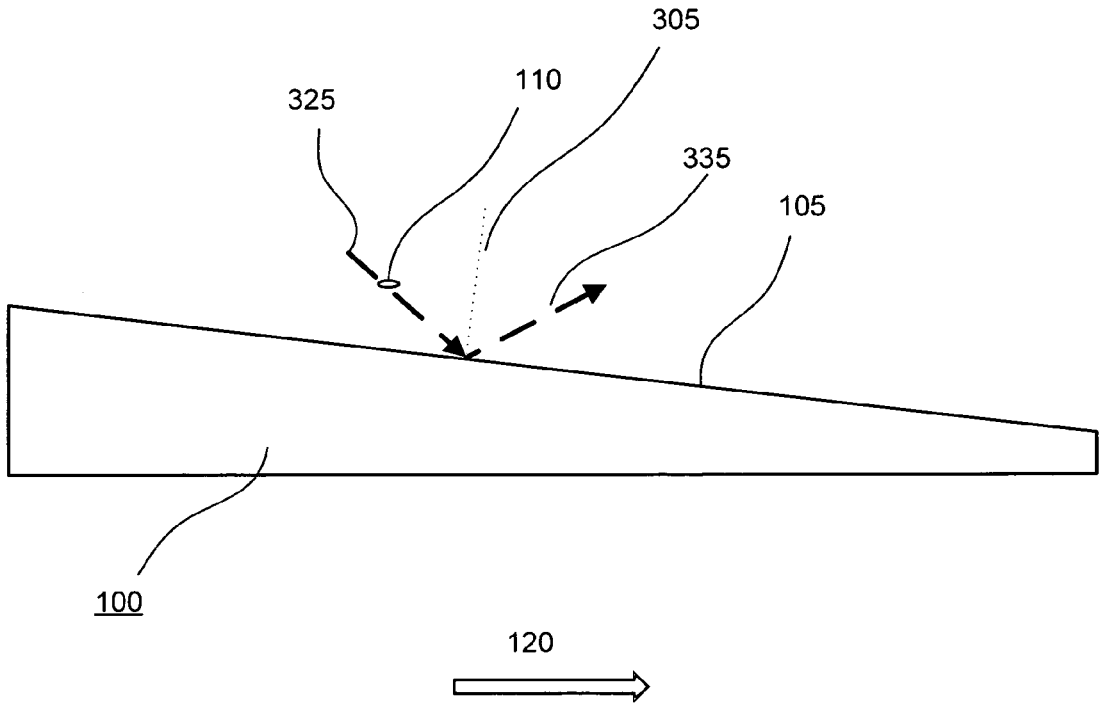
FIG. 3 is an exemplary illustration of a specular collision consistent with the present invention.

FIG. 3 depicts a portion of FIG. 1 in more detail. Specifically, arrow 325 represents a velocity component of constituent particle 110 before constituent particle 110 collides with wall 105. Normal 305 represents an axis that is perpendicular to the plane defined by wall 105. Arrow 335 represents a velocity component of constituent particle 110 after constituent particle 110 collides with wall 105. As used herein, a specular collision between constituent particle 110 and wall 105 is a collision in which the velocity component of constituent particle 110 parallel to the plane of wall 105 is substantially the same before and after the collision. Moreover, during a specular collision, the speed of constituent particle 110 associated with the velocity component perpendicular to the plane of wall 105 may be substantially the same before and after the collision. One skilled in the art should appreciate that the term "specular collision" as used herein should not be interpreted to apply to elastic collisions only. Rather, because there will be a transfer of energy (on the average) between wall 105 of the micro channel and a plurality constituent particles 110, it is understood that any one particular specular collision between constituent particle 110 and wall 105 may increase or decrease the kinetic energy of constituent particle 110 relative to the kinetic energy it possessed prior to the collision. For example, if there is a transfer of energy from wall 105 to constituent particle 110, then one would expect that the acute angle between constituent particle 110 and the plane parallel to wall 105 would be larger after the collision than before the collision. Likewise, if there is a transfer of energy from constituent particle 110 to wall 105, then one would expect that the acute angle between constituent particle 110 and the plane parallel to wall 105 would be smaller after the collision than before the collision. Furthermore, where the temperature of the fluid comprising a plurality of constituent particles is different from the temperature of the wall, there is expected to be a transfer of internal energy from the fluid to the wall, or from the wall to the fluid (depending upon which is at the higher temperature). Where the collisions between a plurality of constituent particles 110 and wall 105 are substantially specular as used herein, the transfer of energy from fluid 115 to wall 105 or from wall 105 to fluid 115 is expected to occur predominantly through the average change in the speed of constituent particle 110 associated with the change in its velocity component perpendicular to the plane of wall 105 during the collision. One should also appreciate that such a change in the velocity component of constituent particle 110 during the collision will change the overall speed of constituent particle 110 as a result of the collision process.

Returning to FIG. 1, fluid 115 that enters micro channel 100 through inflow opening 130 may be induced to flow to outflow opening 150 through the use of a pressure differential between inflow opening 130 and outflow opening 150, where the pressure of fluid 115 at inflow opening 130 is higher than the pressure of fluid 115 at outflow opening. Where the temperature of fluid 115 at inflow opening 130 is $T_1$, then constituent particles 110 (prior to entering region 140) may be represented by a distribution of speeds, the average speed of which is proportional to temperature.

Where the throat of inflow opening is small (for example, anywhere from 0.01 μm^2 to 500 μm^2 where the fluid is air), then constituent particle 110 moving through inflow opening 130 into region 140 will generally exhibit a velocity that has its component parallel to direction 120 larger than its component perpendicular to direction 120. Consequently, fluid 115 acquires a flow velocity that is predominantly parallel to direction 120. The kinetic energy that is associated with the flow of fluid 115 in direction 120 is drawn from the internal thermal energy of fluid 115, which was at $T_1$ before it entered inflow opening 130. Conservation of energy dictates that, because a portion of the original thermal energy of fluid 115 at $T_1$ has been converted to kinetic energy of flow for fluid 115, the temperature of fluid 115 (in a frame that is stationary with the velocity of flow) in region 140 is lower than $T_1$, which we will designate as $T_2$. Where $T_2$ is also less than the temperature of wall 105 (which we will designate as $T_w$) of micro channel 100, then fluid 115 in region 140 will act to cool the material comprising micro channel 100.

Micro channel 100, consistent with an embodiment of the present invention is configured to enhance the effect this temperature change has on fluid 115 in at least three ways. Specifically, where wall 105 and constituent particles 110 are configured such that collisions between wall 105 and constituent particles 110 are substantially specular, then such collisions—which are a means of transferring energy between wall 105 and fluid 115—will have a minimal effect on the overall flow of fluid 115. In other words, where the collision between constituent particle 110 and wall 105 is such that the velocity of constituent particle 110 is equally likely to be in any direction away from wall 105 (i.e., a non-specular collision), then a plurality of such collisions will have the effect of slowing down the flow of fluid 115, which will also likely have the effect of raising the internal temperature of fluid 115 in region 140. Micro channel 100, consistent with an embodiment of the present invention, is configured to enhance the effect of cooling by selectively avoiding the effect of non-specular collisions.

In addition, because wall 105 of micro channel 100 is configured to present a generally increasing cross sectional area through which the flow of fluid 115 occurs, the specular scattering of constituent particle 110 off of wall 105 will convert a portion of the velocity component which was perpendicular to direction 120 to a component parallel to direction 120.

Moreover, because micro channel 100 is engineered to be small (i.e., with an internal surface area that may be as small as approximately 3e-11 m^2 per linear micron to 6e-10 m^2 per linear micro in a preferred embodiment), then the ratio of the surface area presented by wall 105 to a given volume of fluid 115 in region 140 is relatively large (i.e., where the volume of fluid 115 enclosed by the above surface is approximately 8e-17 m^3 per linear micron to 3e-15 m^3 per linear micron). Because the surface area presented by wall 105 to a volume of fluid 115 is a primary means of energy exchange between wall 105 and fluid 115, then this maximizes the overall energy exchange interaction between fluid 115 and micro channel 100.

Figure 4:
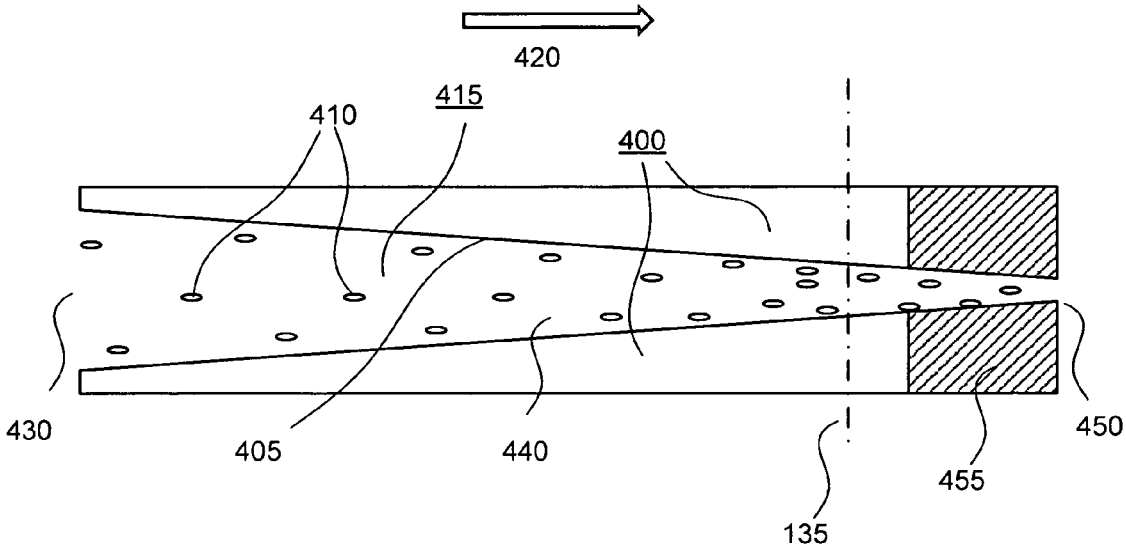
FIG. 4 depicts another embodiment of a micro channel consistent with the present invention.

FIG. 4 depicts a view of another exemplary embodiment consistent with the present invention. Micro channel 400 includes inflow opening 430 and outflow opening 450. Fluid 415, comprising constituent particles 410, flows through micro channel 400 in direction 420. Wall 405 of micro channel 400 is proximal to the flow of fluid 415. The view associated with FIG. 4 is that of a cross sectional slice of micro channel 400 consistent with the present invention. As described previously in connection with micro channel 100, other exemplary cross sectional views of micro channel 400 consistent with the present invention are depicted in FIG. 2, and represent exemplary views consistent with slice 135 (in this instance, shown in FIG. 4). For example the cross section of inflow opening 430, region 440, and outflow opening 450 may be any one of square 101, circle 102, rectangle 103, or any other shape associated with a bounded two-dimensional figure.

Considering FIG. 4 again, the flow of fluid 415 in direction 420 through micro channel 400 may be induced through the use of a pressure differential between inflow opening 430 and outflow opening 450. Moreover, wall 405 and constituent particles 410 are configured such that collisions between constituent particles 410 and wall 405 that are internal in micro channel 400 (where the internal region is represented generally by region 440) are substantially specular.

Fluid 415 that enters micro channel 400 through inflow opening 430 may be induced to flow to outflow opening 450 through, for example, work performed on fluid 415 at inflow opening 430 to generate a flow in direction 420 in the direction of outflow opening 450 (and where, for example, the pressure of fluid 415 at inflow opening 430 is higher than the pressure of fluid 415 at outflow opening). Where the temperature of fluid 415 at inflow opening 430 is $T_1$, then constituent particles 410 (prior to entering region 440) may be represented by a distribution of speeds, the average speed of which is proportional to temperature.

In the embodiment considered in FIG. 4, we consider fluid 415 with an induced flow parallel to direction 420. Consequently, constituent particles 410 in fluid 415 will exhibit more of a velocity component in direction 420 (relative to micro channel 400) than in directions perpendicular to direction 420.

Unlike micro channel 100, however, wall 405 of micro channel 400 is configured to present a generally decreasing cross sectional area through which flow occurs. In this instance, accordingly, the specular scattering of constituent particle 410 off of wall 405 will convert a portion of the velocity component which was parallel to direction 420 to a component perpendicular to direction 420. Such a conversion from flow energy to internal kinetic energy of fluid 415 will tend to raise the temperature of fluid 415. This will become more focused near outflow opening 450. Accordingly, near this region, micro channel 400 is configured to have transferred much of the flow energy associated with fluid 415 at inflow opening 430 into internal kinetic energy of fluid 415.

Under these circumstances, one may desire to thermally isolate that portion of micro channel 400. For example, one may configure a portion of micro channel 400 proximal to outflow opening such that it does not transmit thermal energy to other portions of micro channel 400. This thermally isolated region is depicted in FIG. 4 as region 455.

In addition, where constituent particles 410 of fluid 415 are molecules (and, for example, where fluid 415 is a gas), then certain vibrational states of constituent particles 410 may be populated as a result of the increase in temperature that is achieved near outflow opening 450.

Where such vibrationally-excited molecules subsequently pass through outflow opening 450, then there is a probability that these vibrationally-excited molecules will emit electromagnetic radiation in order to relax to a lower vibrational state. Note also that micro channel 400 may be used to create a population inversion in vibrational states, which is useful for lasing applications, among a collection of such vibrationally-excited molecules that pass through outflow opening 450.

Figure 5:
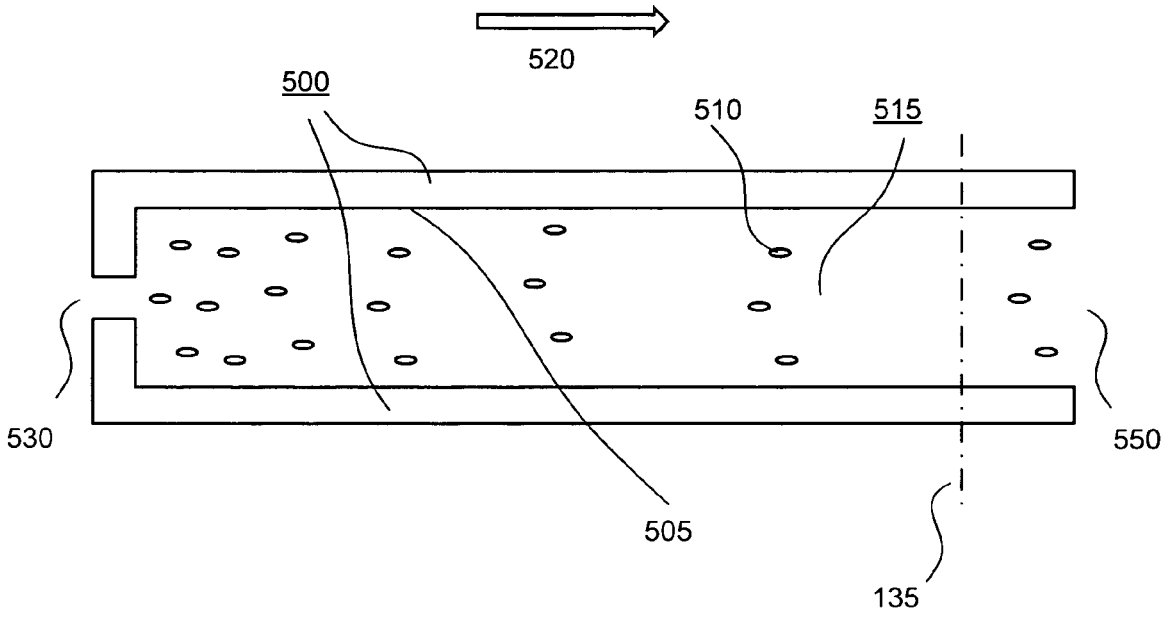
FIG. 5 depicts another embodiment of a micro channel consistent with the present invention.

FIG. 5 depicts another view of an exemplary embodiment consistent with the present invention. Micro channel 500 includes inflow opening 530 and outflow opening 550. Fluid 515, comprising constituent particles 510, flows through micro channel 500 in direction 520. Wall 505 of micro channel 500 is proximal to the flow of fluid 515. The view associated with FIG. 5 is that of a cross sectional slice of micro channel 500 consistent with the present invention. Other exemplary cross sectional views of micro channel 500 consistent with the present invention are depicted in FIG. 2, and represent exemplary views consistent with slice 135 (shown in FIG. 5). For example the cross section of inflow opening 530 and outflow opening 550 may be any one of square 101, circle 102, rectangle 103, or any other shape associated with a bounded two-dimensional figure.

The flow of fluid 515 in direction 520 through micro channel 500 may be induced through the use of a pressure differential between inflow opening 530 and outflow opening 550. Moreover, wall 505 and constituent particles 510 are configured such that collisions between constituent particles 510 and wall 505 that are internal in micro channel 500 are substantially specular.

Fluid 515 that enters micro channel 500 through inflow opening 530 may be induced to flow to outflow opening 550 through the use of a pressure differential between inflow opening 530 and outflow opening 550, where the pressure of fluid 515 at inflow opening 530 is higher than the pressure of fluid 515 at outflow opening. Where the temperature of fluid 515 at inflow opening 530 is $T_1$, then constituent particles 510 (prior to entering micro channel 500) may be represented by a distribution of speeds, the average speed of which is proportional to temperature.

Where the throat of inflow opening is small (for example, anywhere from 0.01 μm^2 to 500 μm^2 where the fluid is air, and where the length of the throat along the direction of the flow is approximately 500 μm), then constituent particle 510 moving through inflow opening 530 into micro channel 500 will generally exhibit a velocity that has its component parallel to direction 520 larger than its component perpendicular to direction 520. Consequently, fluid 515 acquires a flow velocity that is predominantly parallel to direction 520. The kinetic energy that is associated with the flow of fluid 515 in direction 520 is drawn from the internal thermal energy of fluid 515, which was at $T_1$ before it entered inflow opening 530. Conservation of energy dictates that, because a portion of the original thermal energy of fluid 515 at $T_1$ has been converted to kinetic energy of flow for fluid 515, the temperature of fluid 515 (in a frame that is stationary with the velocity of flow) in region 540 is lower than $T_1$, which we will designate as $T_2$. Where $T_2$ is also less than the temperature of wall 505 (which we will designate as $T_w$) of micro channel 500, then fluid 515 in micro channel 500 will act to cool the material comprising micro channel 500.

Micro channel 500, consistent with an embodiment of the present invention is also configured to enhance the effect this temperature change has on fluid 515 in at least three ways. Specifically, where wall 505 and constituent particles 510 are configured such that collisions between wall 505 and constituent particles 510 are substantially specular, then such collisions—which are a means of transferring energy between wall 505 and fluid 515—will have a minimal effect on the overall flow of fluid 515. In other words, where the collision between constituent particle 510 and wall 505 is such that the velocity of constituent particle 510 is equally likely to be in any direction away from wall 505 (i.e., a non-specular collision), then a plurality of such collisions will have the effect of slowing down the flow of fluid 515, which will also likely have the effect of raising the internal temperature of fluid 515 in region 540. Micro channel 500, consistent with an embodiment of the present invention, is configured to enhance the effect of cooling by selectively avoiding the effect of non-specular collisions.

In addition, because the mean free path between constituent particles 510 in fluid 515 is generally increasing as a function of length between inflow opening 530 and outflow opening 550, then it is believed that the specular scattering of constituent particle 510 off of wall 505 as a function of length along micro channel 500 will also likely act to convert a portion of the velocity component which was perpendicular to direction 520 to a component parallel to direction 520.

Moreover, because micro channel 500 is engineered to be small (i.e., with an internal surface area in the substantially constant region that may be as small as approximately 6e-10 m^2 per linear micron in a preferred embodiment in a preferred embodiment), then the ratio of the surface area presented by wall 505 to a given volume of fluid 515 in region 540 is relatively large (i.e., where the volume of fluid 115 enclosed by the above surface is approximately 3e-15 m^3 per linear micron). Because the surface area presented by wall 505 to a volume of fluid 515 is a primary means of energy exchange between wall 505 and fluid 515, then this maximizes the overall energy exchange interaction between fluid 515 and micro channel 500.

Figure 6:
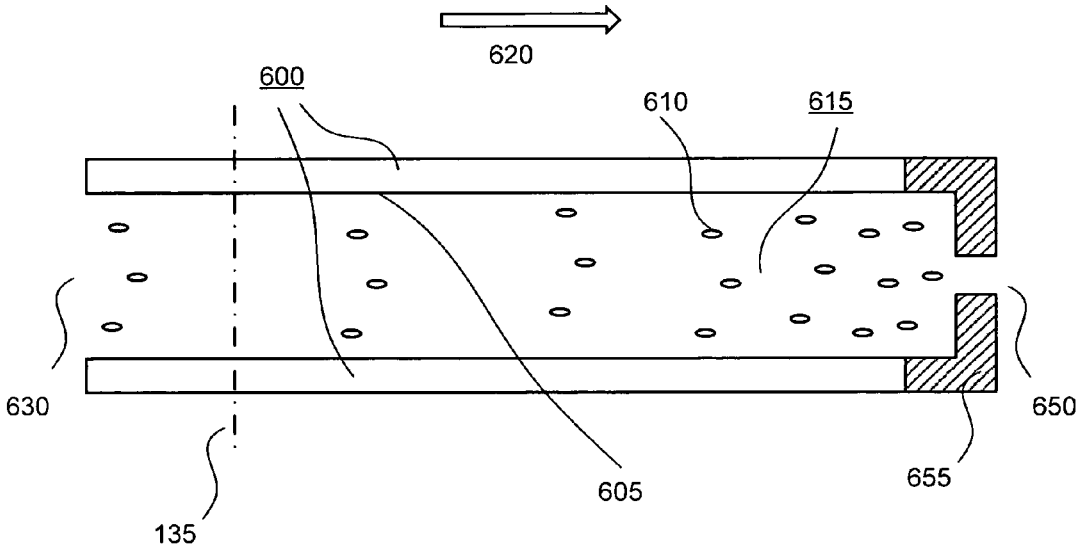
FIG. 6 depicts yet another embodiment consistent with the present invention.

FIG. 6 depicts a view of another exemplary embodiment consistent with the present invention. Micro channel 600 includes inflow opening 630 and outflow opening 650. Fluid 615, comprising constituent particles 610, flows through micro channel 600 in direction 620. Wall 605 of micro channel 600 is proximal to the flow of fluid 615. The view associated with FIG. 6 is that of a cross sectional slice of micro channel 600 consistent with the present invention. As described previously in connection with micro channel 100, other exemplary cross sectional views of micro channel 600 consistent with the present invention are depicted in FIG. 2, and represent exemplary views consistent with slice 135 (in this instance, shown in FIG. 6). For example the cross section of inflow opening 630 and outflow opening 650 may be any one of square 101, circle 102, rectangle 103, or any other shape associated with a bounded two-dimensional figure.

The flow of fluid 615 in direction 620 through micro channel 600 may be induced through the use of a pressure differential between inflow opening 630 and outflow opening 650. Moreover, wall 605 and constituent particles 610 are configured such that collisions between constituent particles 610 and wall 605 that are internal in micro channel 600 (where the internal region is represented generally by region 640) are substantially specular.

Fluid 615 that enters micro channel 600 through inflow opening 630 may be induced to flow to outflow opening 650 through, for example, work performed on fluid 615 at inflow opening 630 to generate a flow in direction 620 in the direction of outflow opening 650 (and where, for example, the pressure of fluid 615 at inflow opening 630 is higher than the pressure of fluid 615 at outflow opening). Where the temperature of fluid 615 at inflow opening 630 is $T_1$, then constituent particles 610 (prior to entering micro channel 600) may be represented by a distribution of speeds, the average speed of which is proportional to temperature.

In the embodiment considered in FIG. 6, we consider fluid 615 with an induced flow parallel to direction 620. Consequently, constituent particles 610 in fluid 615 will exhibit more of a velocity component in direction 620 (relative to micro channel 600) than in directions perpendicular to direction 620.

Unlike micro channel 500, however, wall 605 of micro channel 600 is configured to present a sharply decreasing cross sectional area in the vicinity of outflow opening 650. In this instance, accordingly, the specular scattering of constituent particle 610 off of wall 605 will convert a portion of the velocity component which was parallel to direction 620 to a component anti-parallel to direction 620. Such a conversion from flow energy to internal kinetic energy of fluid 615 will tend to raise the temperature of fluid 615. This will become focused near outflow opening 650. Accordingly, near this region, micro channel 600 is configured to have transferred much of the flow energy associated with fluid 615 at inflow opening 630 into internal kinetic energy of fluid 615.

Under these circumstances, one may desire to thermally isolate that portion of micro channel 600. For example, one may configure a portion of micro channel 600 proximal to outflow opening such that it does not transmit thermal energy to other portions of micro channel 600. This thermally isolated region is depicted in FIG. 6 as region 655.

Where constituent particles 610 of fluid 615 are molecules (and, for example, where fluid 615 is a gas), then certain vibrational states of constituent particles 610 may be populated as a result of the increase in temperature that is achieved near outflow opening 650.

Where such vibrationally-excited molecules subsequently pass through outflow opening 650, then there is a probability that these vibrationally-excited molecules will emit electromagnetic radiation in order to relax to a lower vibrational state. Note also that micro channel 600 may be used to create a population inversion in vibrational states, which is useful for lasing applications, among a collection of such vibrationally-excited molecules that pass through outflow opening 650.

Figure 7:
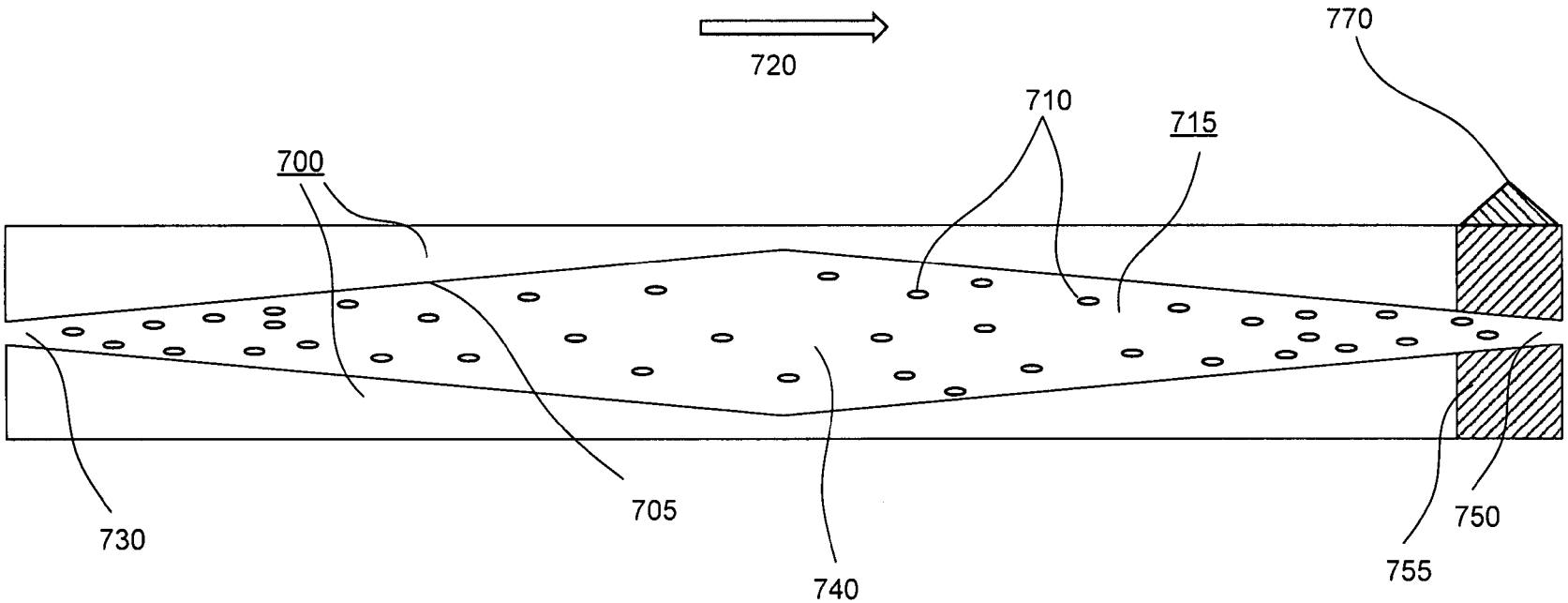
FIG. 7 depicts an embodiment consistent with the present invention utilizing a serial configuration of the embodiments consistent with FIGS. 1 and 4.

FIG. 7 depicts a view of another exemplary embodiment consistent with the present invention. Micro channel 700, consistent with an embodiment of the present invention, is configured to utilize a linear combination of the exemplary embodiments depicted in FIG. 1 and FIG. 4.

Accordingly, the discussions relevant to the embodiments depicted in FIGS. 1 and 4 are herein incorporated by reference.

Micro channel 700 includes inflow opening 730 and outflow opening 750. Fluid 715, comprising constituent particles 710, flows through micro channel 700 in direction 720. Wall 705 of micro channel 700 is proximal to the flow of fluid 715. The view associated with FIG. 7 is that of a cross sectional slice of micro channel 700 similar to the views presented in FIGS. 1 and 4.

Fluid 715 that enters micro channel 700 through inflow opening 730 may be induced to flow to outflow opening 750 through the use of a pressure differential between inflow opening 730 and outflow opening 750, where the pressure of fluid 715 at inflow opening 730 is higher than the pressure of fluid 715 at outflow opening. Moreover, wall 705 and constituent particles 710 are configured such that collisions between constituent particles 710 and wall 705 that are internal in micro channel 700 are substantially specular.

Where the temperature of fluid 715 at inflow opening 730 is $T_1$, then constituent particles 710 (prior to entering micro channel 700) may be represented by a distribution of speeds, the average speed of which is proportional to temperature.

Where the throat of inflow opening is small (for example, anywhere from 0.01 μm^2 to 500 μm^2), then constituent particle 710 moving through inflow opening 730 into micro channel 700 will generally exhibit a velocity that has its component parallel to direction 720 larger than its component perpendicular to direction 720. Consequently, fluid 715 initially acquires a flow velocity that is predominantly parallel to direction 720. The kinetic energy that is associated with the flow of fluid 715 in direction 720 is drawn from the internal thermal energy of fluid 715, which was at $T_1$ before it entered inflow opening 730. Conservation of energy dictates that, because a portion of the original thermal energy of fluid 715 at $T_1$ has been converted to kinetic energy of flow for fluid 715, the temperature of fluid 715 (in a frame that is stationary with the velocity of flow) prior to midpoint 740 is lower than $T_1$, which we will designate as $T_2$. Where $T_2$ is also less than the temperature of wall 705 between inflow opening 730 and midpoint 740 (which we will designate as $T_w$) of micro channel 700, then fluid 715 in the region between inflow opening 730 and midpoint 740 will act to cool the material comprising micro channel 700.

Micro channel 700, consistent with an embodiment of the present invention is configured to enhance the effect this temperature change has on fluid 715 in at least three ways. Specifically, where wall 705 and constituent particles 710 are configured such that collisions between wall 705 and constituent particles 710 are substantially specular, then such collisions—which are a means of transferring energy between wall 705 and fluid 715—will have a minimal effect on the overall flow of fluid 715. In other words, where the collision between constituent particle 710 and wall 705 is such that the velocity of constituent particle 710 is equally likely to be in any direction away from wall 705 (i.e., a non-specular collision), then a plurality of such collisions will have the effect of slowing down the flow of fluid 715, which will also likely have the effect of raising the internal temperature of fluid 715 in region between inflow opening 730 and midpoint 740. Micro channel 700, consistent with an embodiment of the present invention, is configured to enhance the effect of cooling by selectively avoiding the effect of non-specular collisions in this region.

In addition, because wall 705 of micro channel 700 is configured to present a generally increasing cross sectional area between inflow opening 730 and midpoint 740 through which the flow of fluid 715 occurs, the specular scattering of constituent particle 710 off of wall 705 will convert a portion of the velocity component which was perpendicular to direction 720 to a component parallel to direction 720.

Moreover, because micro channel 700 is engineered to be small (i.e., with an internal surface area that may be as small as approximately 3e-11 m^2 per linear micron to 6e-10 m^2 per linear micron in a preferred embodiment), then the ratio of the surface area presented by wall 705 to a given volume of fluid 715 in micro channel 700 is relatively large (i.e., where the volume of fluid 115 enclosed by the above surface is approximately 8e-17 m^3 per linear micron to 3e-15 m^3 per linear micron). Because the surface area presented by wall 705 to a volume of fluid 715 is a primary means of energy exchange between wall 705 and fluid 715, then this maximizes the overall energy exchange interaction between fluid 715 and micro channel 700.

Considering micro channel 700 between midpoint 740 and outflow opening 750, fluid 715 has an induced flow (that may be enhanced through the cooling effect of wall 705 between inflow opening 730 and midpoint 740) parallel to direction 720. Consequently, constituent particles 710 in fluid 715 in this region will exhibit more of a velocity component in direction 720 (relative to micro channel 700) than in directions perpendicular to direction 720.

Unlike the region between inflow opening 730 and midpoint 740, however, wall 705 of micro channel 700 is configured to present a generally decreasing cross sectional area through which flow occurs between midpoint 740 and outflow opening 750. In this region, accordingly, the specular scattering of constituent particle 710 off of wall 705 will convert a portion of the velocity component which was parallel to direction 720 to a component perpendicular to direction 720. Such a conversion from flow energy to internal kinetic energy of fluid 715 will tend to raise the temperature of fluid 715. This will become more focused near outflow opening 750. Accordingly, near this region, micro channel 700 is configured to have transferred much of the flow energy associated with fluid 715 at midpoint 740 (which includes some of the energy associated with the cooling of wall 705 between inflow opening 730 and midpoint 740) into internal kinetic energy of fluid 715.

Under these circumstances, one may desire to thermally isolate that portion of micro channel 700. For example, one may configure a portion of micro channel 700 proximal to outflow opening such that it does not transmit thermal energy to other portions of micro channel 700. This thermally isolated region is depicted in FIG. 7 as region 755. In addition, thermoelectric device 770 may be configured to extract the thermal energy localized in region 755. Thermoelectric device 770 may be any such device that is conventionally available, such as, without limitation, part 1261G-7L31-04CQ commercially available from Custom Thermoelectric.

Where constituent particles 710 of fluid 715 are molecules (and, for example, where fluid 715 is a gas), then certain vibrational states of constituent particles 710 may be populated as a result of the increase in temperature that is achieved near outflow opening 750.

Where such vibrationally-excited molecules subsequently pass through outflow opening 750, then there is a probability that these vibrationally-excited molecules will emit electromagnetic radiation in order to relax to a lower vibrational state. Note also that micro channel 700 may be used to create a population inversion in vibrational states, which is useful for lasing applications, among a collection of such vibrationally-excited molecules that pass through outflow opening 750.

Figure 8:
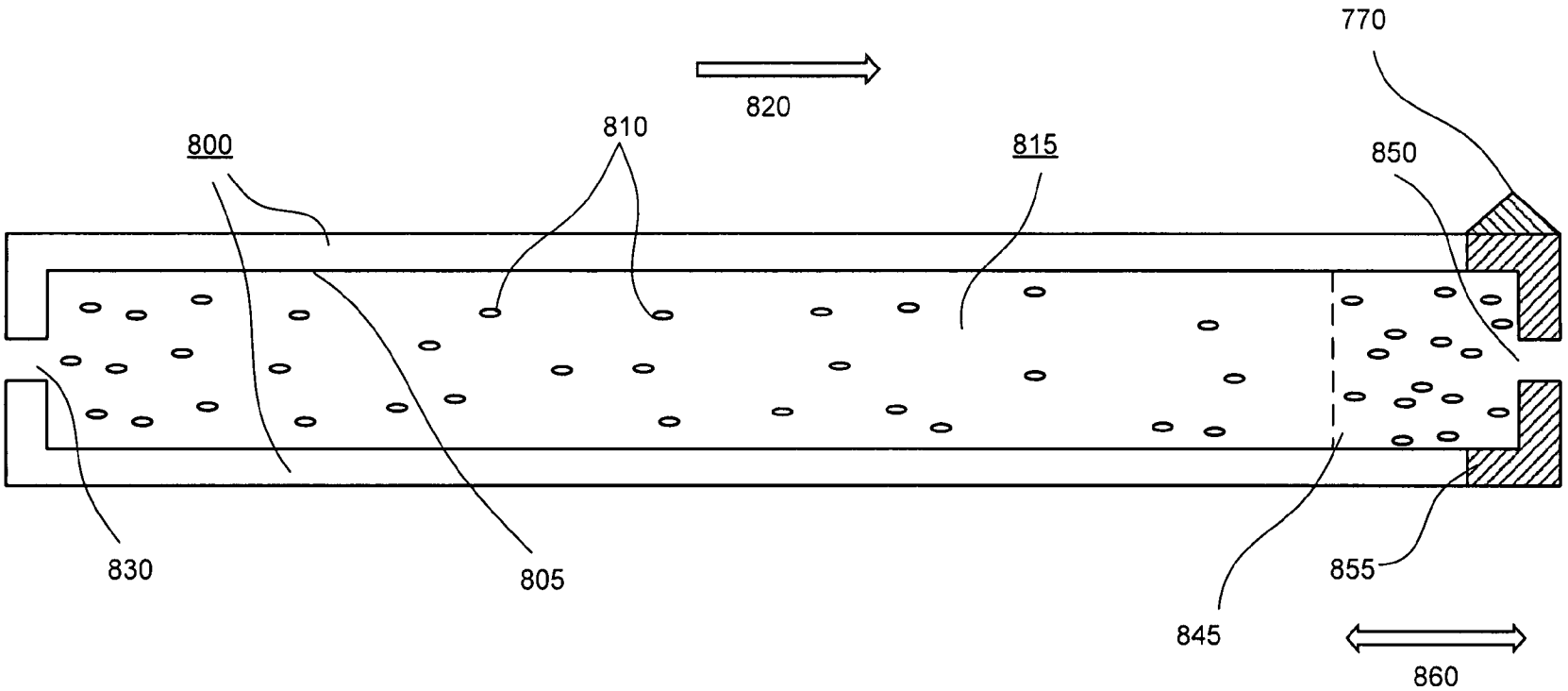
FIG. 8 depicts an embodiment consistent with the present invention utilizing a serial configuration of the embodiments consistent with FIGS. 5 and 6.

FIG. 8 depicts a view of another exemplary embodiment consistent with the present invention. Micro channel 800, consistent with an embodiment of the present invention, is configured to utilize a linear combination of the exemplary embodiments depicted in FIG. 5 and FIG. 6.

Accordingly, the discussions relevant to the embodiments depicted in FIGS. 5 and 6 are herein incorporated by reference.

Micro channel 800 includes inflow opening 830 and outflow opening 850. Fluid 815, comprising constituent particles 810, flows through micro channel 800 in direction 820. Wall 805 of micro channel 800 is proximal to the flow of fluid 815.

The view associated with FIG. 8 is that of a cross sectional slice of micro channel 800 similar to the views presented in FIGS. 5 and 6.

Fluid 815 that enters micro channel 800 through inflow opening 830 may be induced to flow to outflow opening 850 through the use of a pressure differential between inflow opening 830 and outflow opening 850, where the pressure of fluid 815 at inflow opening 830 is higher than the pressure of fluid 815 at outflow opening. Moreover, wall 805 and constituent particles 810 are configured such that collisions between constituent particles 810 and wall 805 that are internal in micro channel 800 are substantially specular.

Where the temperature of fluid 815 at inflow opening 830 is $T_1$, then constituent particles 810 (prior to entering micro channel 800) may be represented by a distribution of speeds, the average speed of which is proportional to temperature.

Where the throat of inflow opening is small (for example, anywhere from 0.01 μm^2 to 500 μm^2 where the fluid is air, and where the length of the throat along the direction of the flow is approximately 500 μm), then constituent particle 810 moving through inflow opening 830 into micro channel 800 will generally exhibit a velocity that has its component parallel to direction 820 larger than its component perpendicular to direction 820. Consequently, fluid 815 initially acquires a flow velocity that is predominantly parallel to direction 820. The kinetic energy that is associated with the flow of fluid 815 in direction 820 is drawn from the internal thermal energy of fluid 815, which was at $T_1$ before it entered inflow opening 830. Conservation of energy dictates that, because a portion of the original thermal energy of fluid 815 at $T_1$ has been converted to kinetic energy of flow for fluid 815, the temperature of fluid 815 (in a frame that is stationary with the velocity of flow) prior to region 845 (discussed below) is lower than $T_1$, which we will designate as $T_2$. Where $T_2$ is also less than the temperature of wall 805 between inflow opening 830 and region 845 (which we will designate as $T_w$) of micro channel 800, then fluid 815 in the region between inflow opening 830 and region 845 will act to cool the material comprising micro channel 800.

Micro channel 800, consistent with an embodiment of the present invention is configured to enhance the effect this temperature change has on fluid 815 in at least three ways. Specifically, where wall 805 and constituent particles 810 are configured such that collisions between wall 805 and constituent particles 810 are substantially specular, then such collisions—which are a means of transferring energy between wall 805 and fluid 815—will have a minimal effect on the overall flow of fluid 815. In other words, where the collision between constituent particle 810 and wall 805 is such that the velocity of constituent particle 810 is equally likely to be in any direction away from wall 805 (i.e., a non-specular collision), then a plurality of such collisions will have the effect of slowing down the flow of fluid 815, which will also likely have the effect of raising the internal temperature of fluid 815 in region between inflow opening 830 and region 845. Micro channel 800, consistent with an embodiment of the present invention, is configured to enhance the effect of cooling by selectively avoiding the effect of non-specular collisions in this region.

In addition, because the mean free path between constituent particles 810 in fluid 815 is generally increasing as a function of length between inflow opening 830 and region 845, then it is believed that the specular scattering of constituent particle 810 off of wall 805 as a function of length along micro channel 800 will also likely act to convert a portion of the velocity component which was perpendicular to direction 820 to a component parallel to direction 820.

Moreover, because micro channel 800 is engineered to be small (i.e., with an internal surface area that may be as small as approximately 6e-10 m^2 per linear micron in a preferred embodiment), then the ratio of the surface area presented by wall 805 to a given volume of fluid 815 in micro channel 800 is relatively large (i.e., where the volume of fluid enclosed by the above surface area is approximately 3e-15 m^3 per linear micron). Because the surface area presented by wall 805 to a volume of fluid 815 is a primary means of energy exchange between wall 805 and fluid 815, then this maximizes the overall energy exchange interaction between fluid 815 and micro channel 800.

Considering micro channel 800 in region 845 proximal to outflow opening 850, fluid 815 has an induced flow (that may be enhanced through the cooling effect of wall 805 between inflow opening 830 and region 845) parallel to direction 820. Consequently, constituent particles 810 in fluid 815 in the region between inflow opening 830 and region 845 will exhibit more of a velocity component in direction 820 (relative to micro channel 800) than in directions perpendicular to direction 820.

Unlike the region between inflow opening 830 and region 845, however, wall 855 of micro channel 800 is configured to present an abrupt decrease in the cross sectional area through which flow occurs at outflow opening 850. In region 845, accordingly, the specular scattering of constituent particle 810 off of wall 855 and the subsequent collision between constituent particles 810 in region 845 will convert a portion of the velocity component which was parallel to direction 820 to a component perpendicular to direction 820. Such a conversion from flow energy to internal kinetic energy of fluid 815 will tend to raise the temperature of fluid 815. This is indicated to occur in FIG. 8 in region 845, near outflow opening 850. Accordingly, in region 845, micro channel 800 is configured to have transferred much of the flow energy associated with fluid 815 between inflow opening 830 and region 845 (which includes some of the energy associated with the cooling of wall 805 between inflow opening 830 and region 845) into internal kinetic energy of fluid 815.

Under these circumstances, one may desire to thermally isolate that portion of micro channel 800. For example, one may configure a portion of micro channel 800 proximal to outflow opening such that it does not transmit thermal energy to other portions of micro channel 800. This thermally isolated region is depicted in FIG. 8 as region 855. In addition, thermoelectric device 770 may be configured to extract the thermal energy localized in region 855. As has been discussed, thermoelectric device 770 may be any such device that is conventionally available, such as, without limitation, part 1261G-7L31-04CQ commercially available from Custom Thermoelectric.

Where constituent particles 810 of fluid 815 are molecules (and, for example, where fluid 815 is a gas), then certain vibrational states of constituent particles 810 may be populated as a result of the increase in temperature that is achieved near outflow opening 850.

Where such vibrationally-excited molecules subsequently pass through outflow opening 850, then there is a probability that these vibrationally-excited molecules will emit electromagnetic radiation in order to relax to a lower vibrational state. Note also that micro channel 800 may be used to create a population inversion in vibrational states, which is useful for lasing applications, among a collection of such vibrationally-excited molecules that pass through outflow opening 850.

Figure 9:
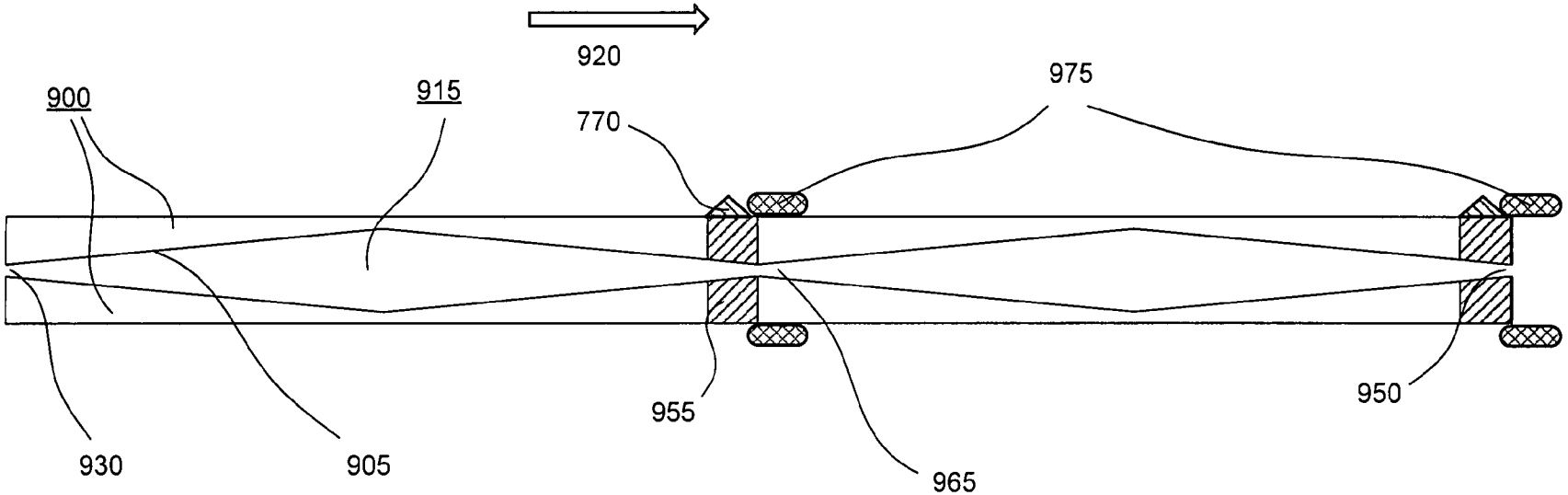
FIG. 9 depicts an embodiment consistent with the present invention utilizing a serial configuration of the embodiment consistent with FIG. 7.

FIG. 9 depicts a view of another exemplary embodiment consistent with the present invention. Micro channel 900, consistent with an embodiment of the present invention, is configured to utilize a linear combination of the exemplary embodiment depicted in FIG. 7.

Accordingly, the discussion relevant to the embodiment depicted in FIG. 7 is herein incorporated by reference.

Micro channel 900 includes inflow opening 930 and outflow opening 950. Fluid 915 flows through micro channel 900 in direction 920. Wall 905 of micro channel 900 is proximal to the flow of fluid 915. The view associated with FIG. 9 is that of a cross sectional slice of micro channel 900 similar to the view presented in FIG. 7.

Fluid 915 that enters micro channel 900 through inflow opening 930 may be induced to flow to outflow opening 950 through the use of a pressure differential between inflow opening 930 and outflow opening 950, where the pressure of fluid 915 at inflow opening 930 is higher than the pressure of fluid 915 at outflow opening. Moreover, wall 905 and the constituent particles of fluid 915 are configured such that collisions between the constituent particles and wall 905 that are internal in micro channel 900 are substantially specular.

As with the embodiment discussed in FIG. 7, one may desire to thermally isolate those portions of micro channel 900 that may be heated by fluid 915. In the embodiment depicted in FIG. 9, portions of micro channel 900 proximal to region 965 and to out flow opening 950 are configured such that they do not transmit thermal energy to other portions of micro channel 900. These thermally isolated regions are depicted in FIG. 9 as region 955. As discussed earlier, thermoelectric device 770 may be configured to extract the thermal energy localized in region 955. Thermoelectric device 770 may be any such device that is conventionally available, such as, without limitation, part 1261G-7L31-04CQ commercially available from Custom Thermoelectric.

Also, as discussed earlier, where the constituent particles of fluid 915 are molecules (and, for example, where fluid 915 is a gas), then certain vibrational states of the constituent particles may be populated as a result of the increase in temperature that is achieved near region 965 and outflow opening 950.

Where such vibrationally-excited molecules subsequently pass through region 965 and outflow opening 950, then there is a probability that these vibrationally-excited molecules will emit electromagnetic radiation in order to relax to a lower vibrational state. Photoelectric device 975 may be used to utilize the electromagnetic energy that is generated as a result of such electromagnetic emissions. In the vicinity of photoelectric device 975, micro channel 900 may be configured to be transparent to the emitted radiation.

Figure 10:
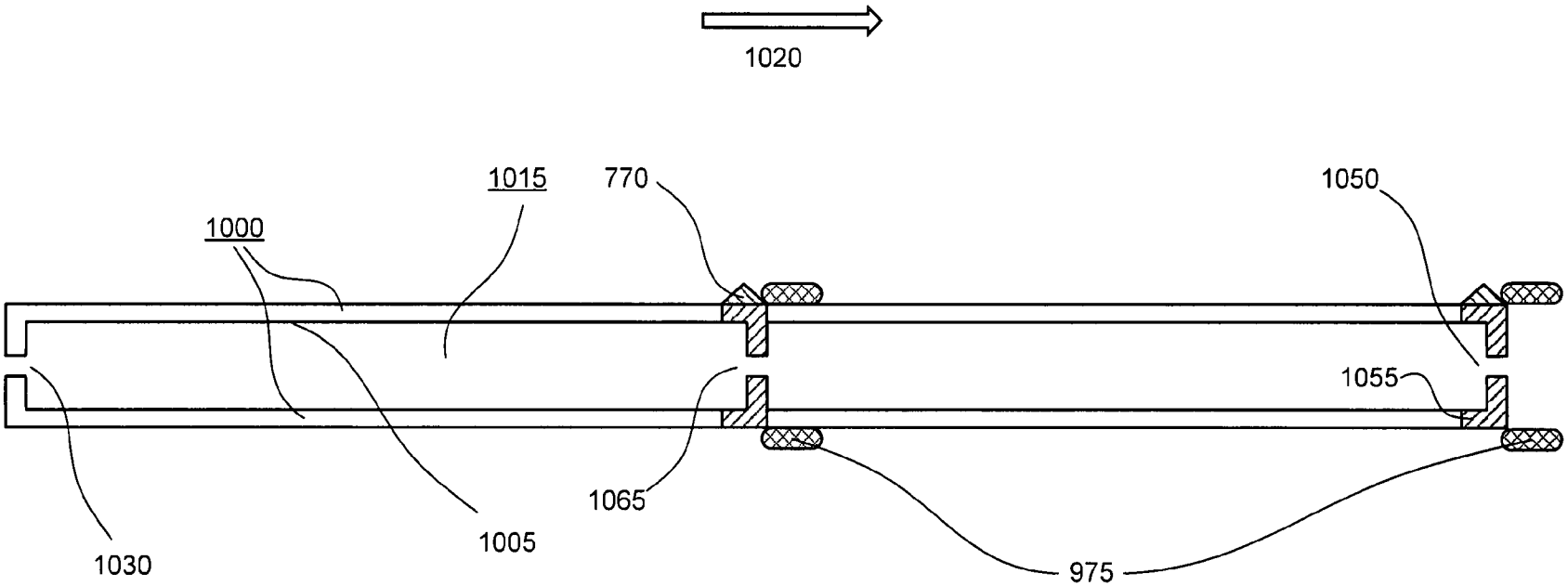
FIG. 10 depicts an embodiment consistent with the present invention utilizing a serial configuration of the embodiment consistent with FIG. 8.

FIG. 10 depicts a view of another exemplary embodiment consistent with the present invention. Micro channel 1000, consistent with an embodiment of the present invention, is configured to utilize a linear combination of the exemplary embodiment depicted in FIG. 8.

Accordingly, the discussion relevant to the embodiment depicted in FIG. 8 is herein incorporated by reference.

Micro channel 1000 includes inflow opening 1030 and outflow opening 1050. Fluid 1015 flows through micro channel 1000 in direction 1020. Wall 1005 of micro channel 1000 is proximal to the flow of fluid 1015. The view associated with FIG. 10 is that of a cross sectional slice of micro channel 1000 similar to the view presented in FIG. 8.

Fluid 1015 that enters micro channel 1000 through inflow opening 1030 may be induced to flow to outflow opening 1050 through the use of a pressure differential between inflow opening 1030 and outflow opening 1050, where the pressure of fluid 1015 at inflow opening 1030 is higher than the pressure of fluid 1015 at outflow opening. Moreover, wall 1005 and the constituent particles of fluid 1015 are configured such that collisions between the constituent particles and wall 1005 that are internal in micro channel 1000 are substantially specular.

As with the embodiment discussed in FIG. 8, one may desire to thermally isolate those portions of micro channel 1000 that may be heated by fluid 1015. In the embodiment depicted in FIG. 10, portions of micro channel 1000 proximal to region 1065 and to out flow opening 1050 are configured such that they do not transmit thermal energy to other portions of micro channel 1000. These thermally isolated regions are depicted in FIG. 10 as region 1055. As discussed earlier, thermoelectric device 770 may be configured to extract the thermal energy localized in region 1055. Thermoelectric device 770 may be any such device that is conventionally available, such as, without limitation, part 1261G-7L31-04CQ commercially available from Custom Thermoelectric.

Also, as discussed earlier, where the constituent particles of fluid 1015 are molecules (and, for example, where fluid 1015 is a gas), then certain vibrational states of the constituent particles may be populated as a result of the increase in temperature that is achieved near region 1065 and outflow opening 1050.

Where such vibrationally-excited molecules subsequently pass through region 1065 and outflow opening 1050, then there is a probability that these vibrationally-excited molecules will emit electromagnetic radiation in order to relax to a lower vibrational state. Photoelectric device 975 may be used to utilize the electromagnetic energy that is generated as a result of such electromagnetic emissions. In the vicinity of photoelectric device 975, micro channel 1000 may be configured to be transparent to the emitted radiation.

Figure 11:
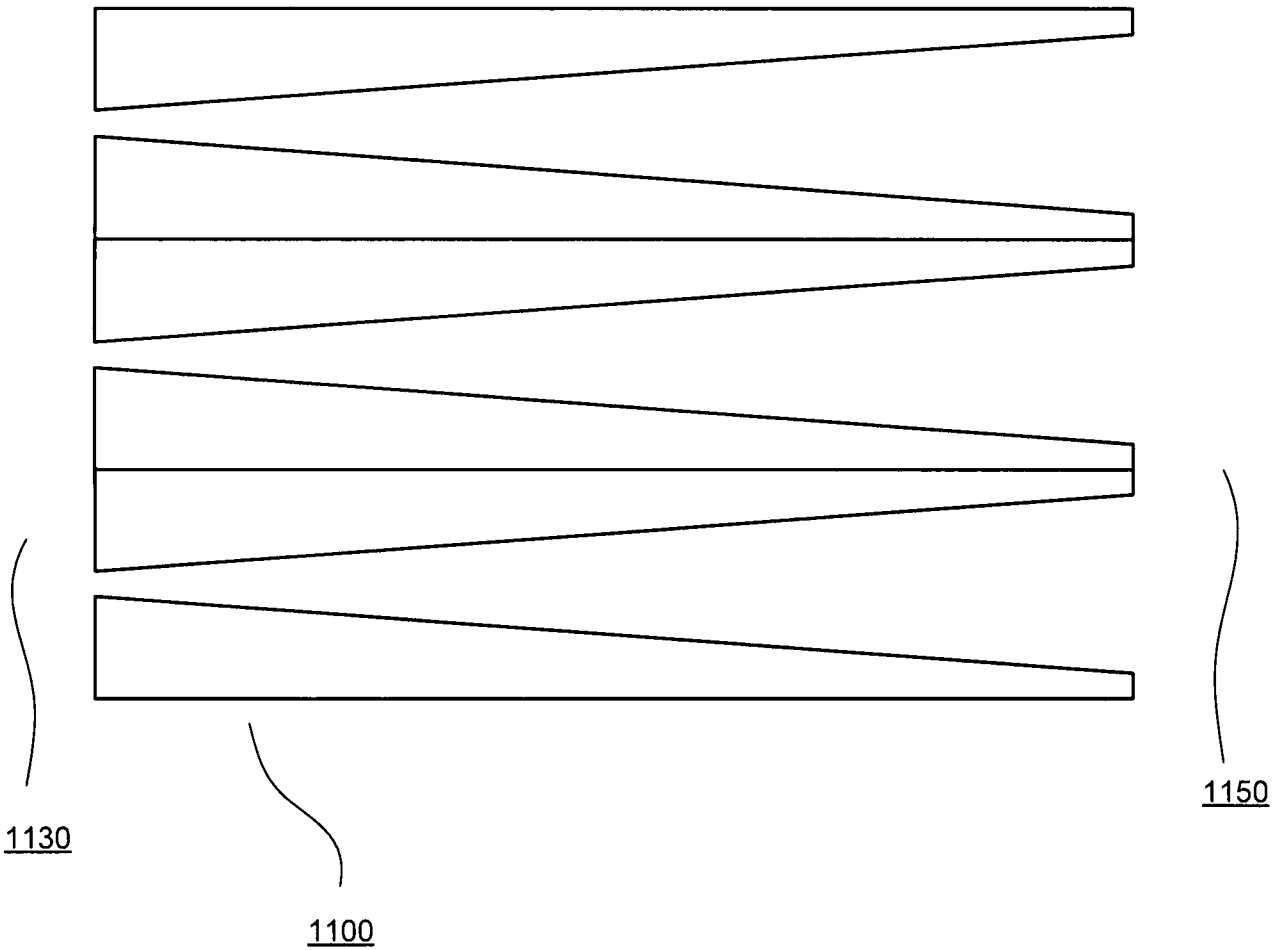
FIG. 11 depicts an embodiment consistent with the present invention utilizing a parallel configuration of the embodiment consistent with FIG. 1.

FIG. 11 depicts a view of another exemplary embodiment consistent with the present invention. Micro channel 1100, consistent with an embodiment of the present invention, is configured to utilize a parallel combination of the exemplary embodiment depicted in FIG. 1. Accordingly, the discussion relevant to the embodiment depicted in FIG. 1 is herein incorporated by reference. In the embodiment depicted in FIG. 11, fluid enters through inflow openings 1130 and exits through outflow openings 1150.

Figure 12:
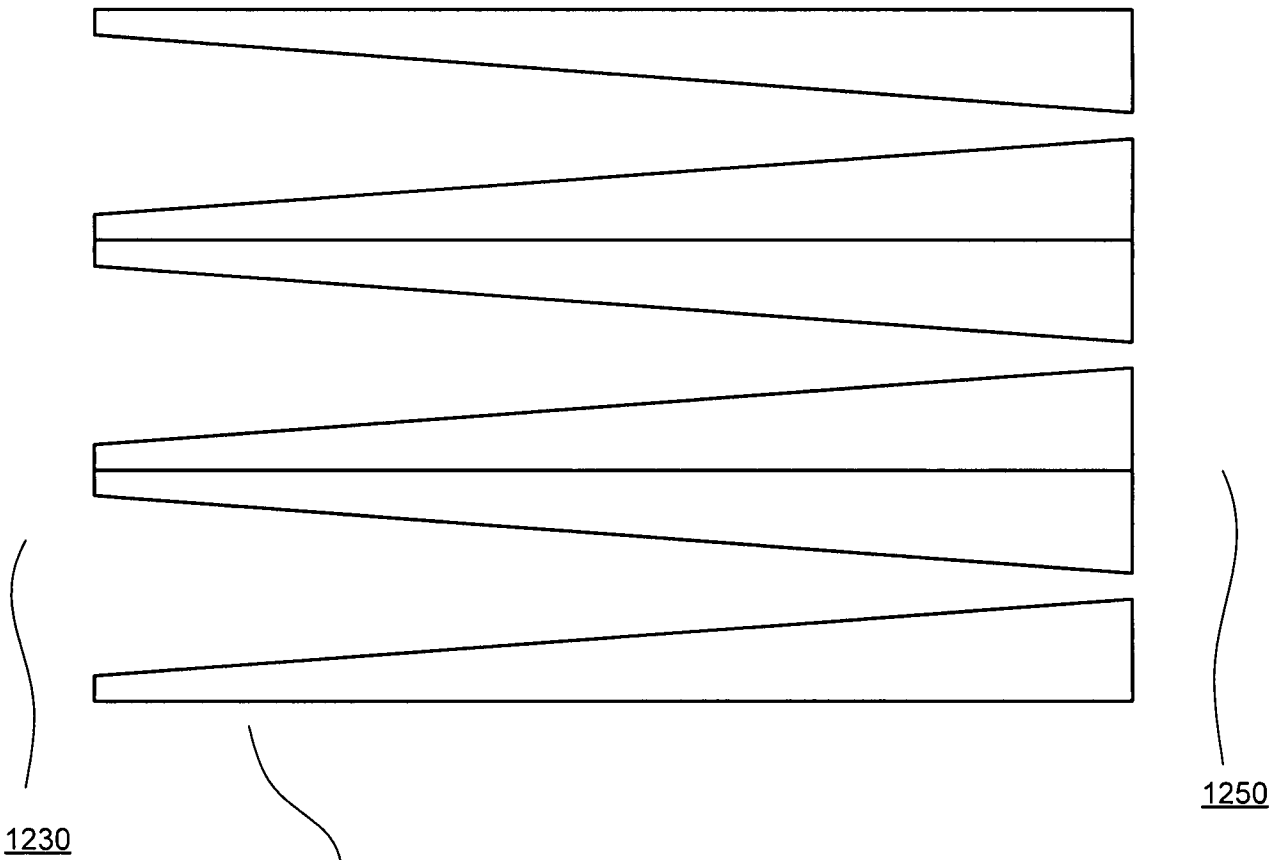
FIG. 12 depicts an embodiment consistent with the present invention utilizing a parallel configuration of the embodiment consistent with FIG. 4.

FIG. 12 depicts a view of another exemplary embodiment consistent with the present invention. Micro channel 1200, consistent with an embodiment of the present invention, is configured to utilize a parallel combination of the exemplary embodiment depicted in FIG. 4. Accordingly, the discussion relevant to the embodiment depicted in FIG. 4 is herein incorporated by reference. In the embodiment depicted in FIG. 12, fluid enters through inflow openings 1230 and exits through outflow openings 1250.

Figure 13:
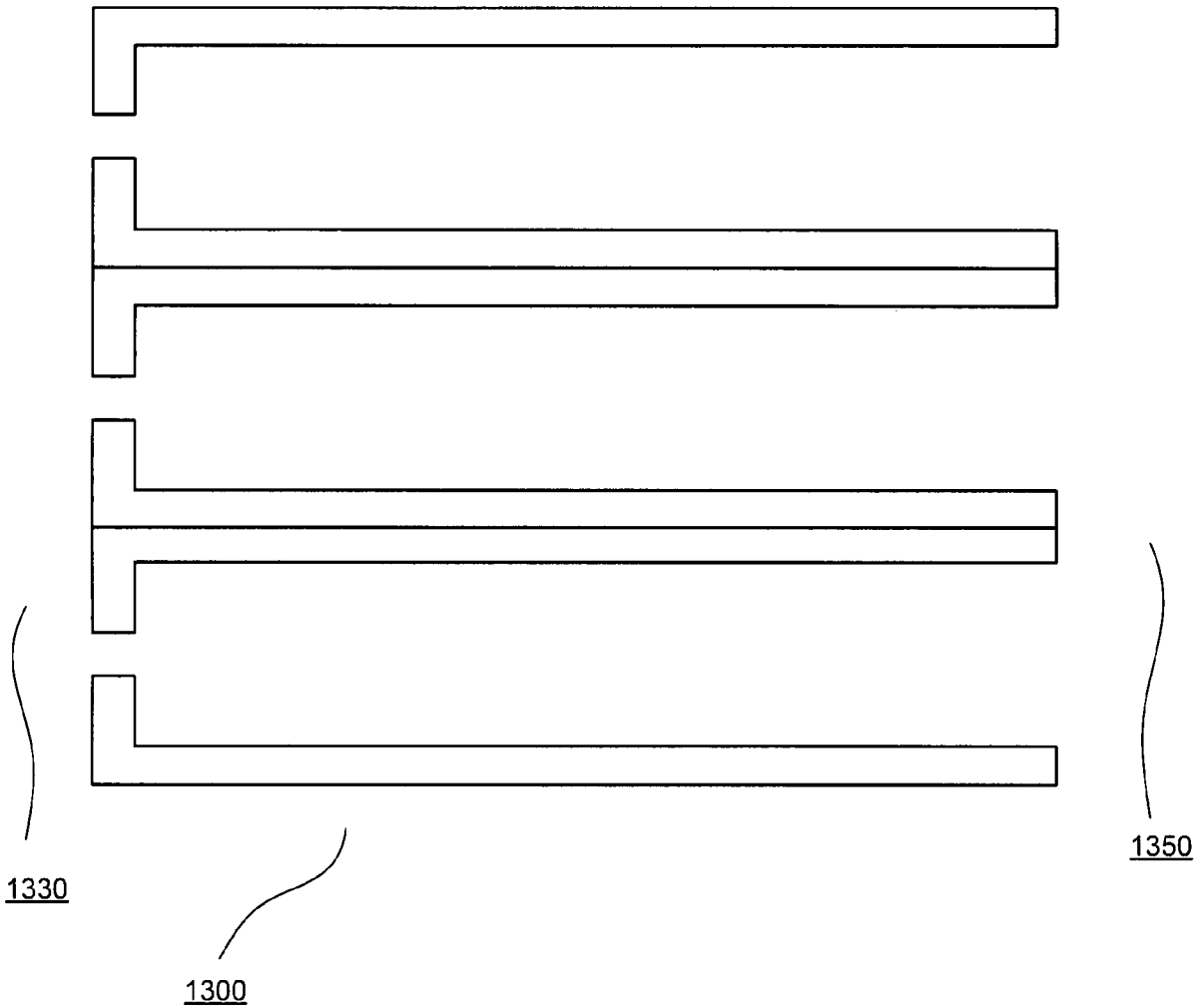
FIG. 13 depicts an embodiment consistent with the present invention utilizing a parallel configuration of the embodiment consistent with FIG. 5.

FIG. 13 depicts a view of another exemplary embodiment consistent with the present invention. Micro channel 1300, consistent with an embodiment of the present invention, is configured to utilize a parallel combination of the exemplary embodiment depicted in FIG. 5. Accordingly, the discussion relevant to the embodiment depicted in FIG. 5 is herein incorporated by reference. In the embodiment depicted in FIG. 13, fluid enters through inflow openings 1330 and exits through outflow openings 1350.

Figure 14:
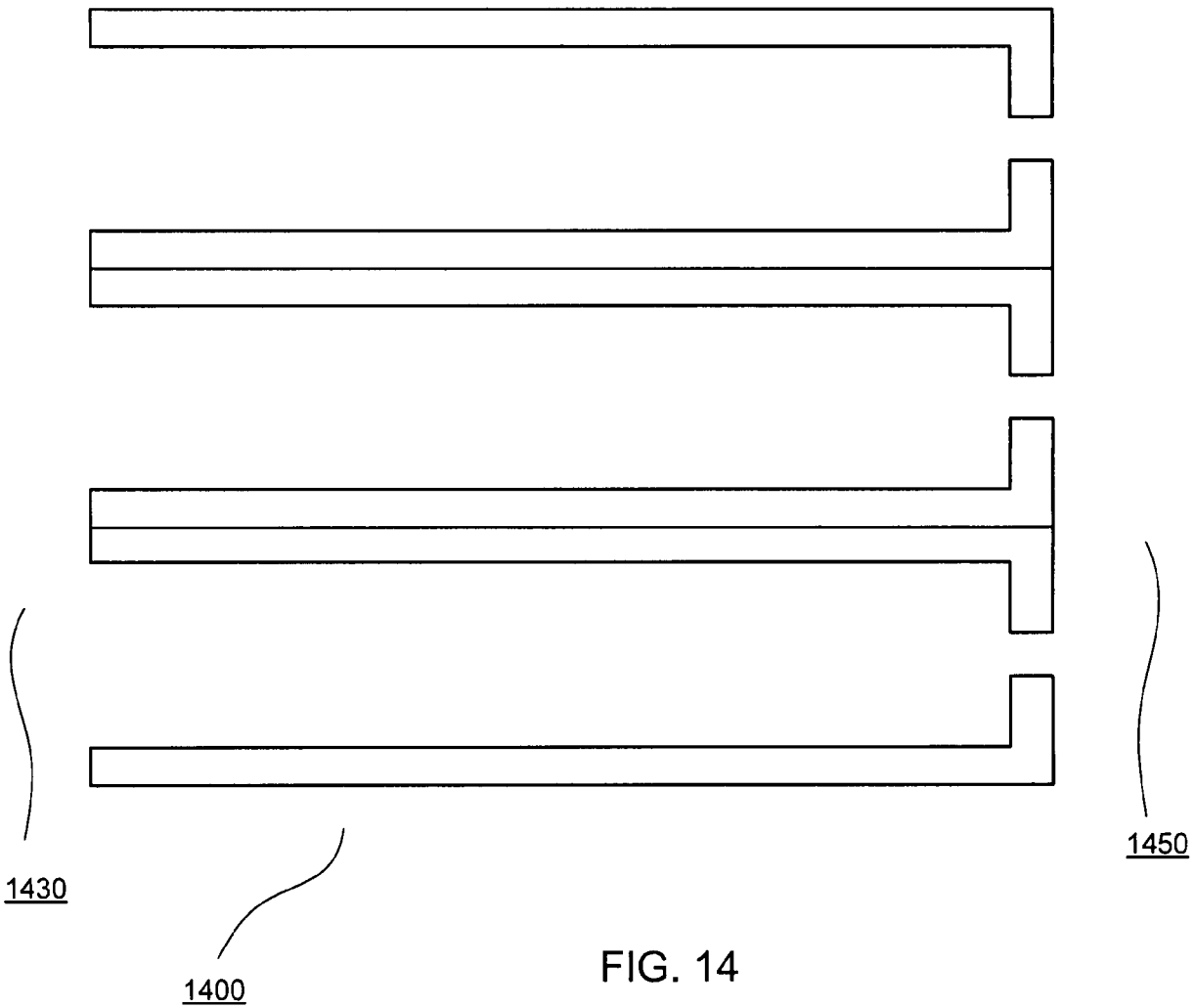
FIG. 14 depicts an embodiment consistent with the present invention utilizing a parallel configuration of the embodiment consistent with FIG. 6.

FIG. 14 depicts a view of another exemplary embodiment consistent with the present invention. Micro channel 1400, consistent with an embodiment of the present invention, is configured to utilize a parallel combination of the exemplary embodiment depicted in FIG. 6. Accordingly, the discussion relevant to the embodiment depicted in FIG. 6 is herein incorporated by reference. In the embodiment depicted in FIG. 14, fluid enters through inflow openings 1430 and exits through outflow openings 1450.

Figure 15:
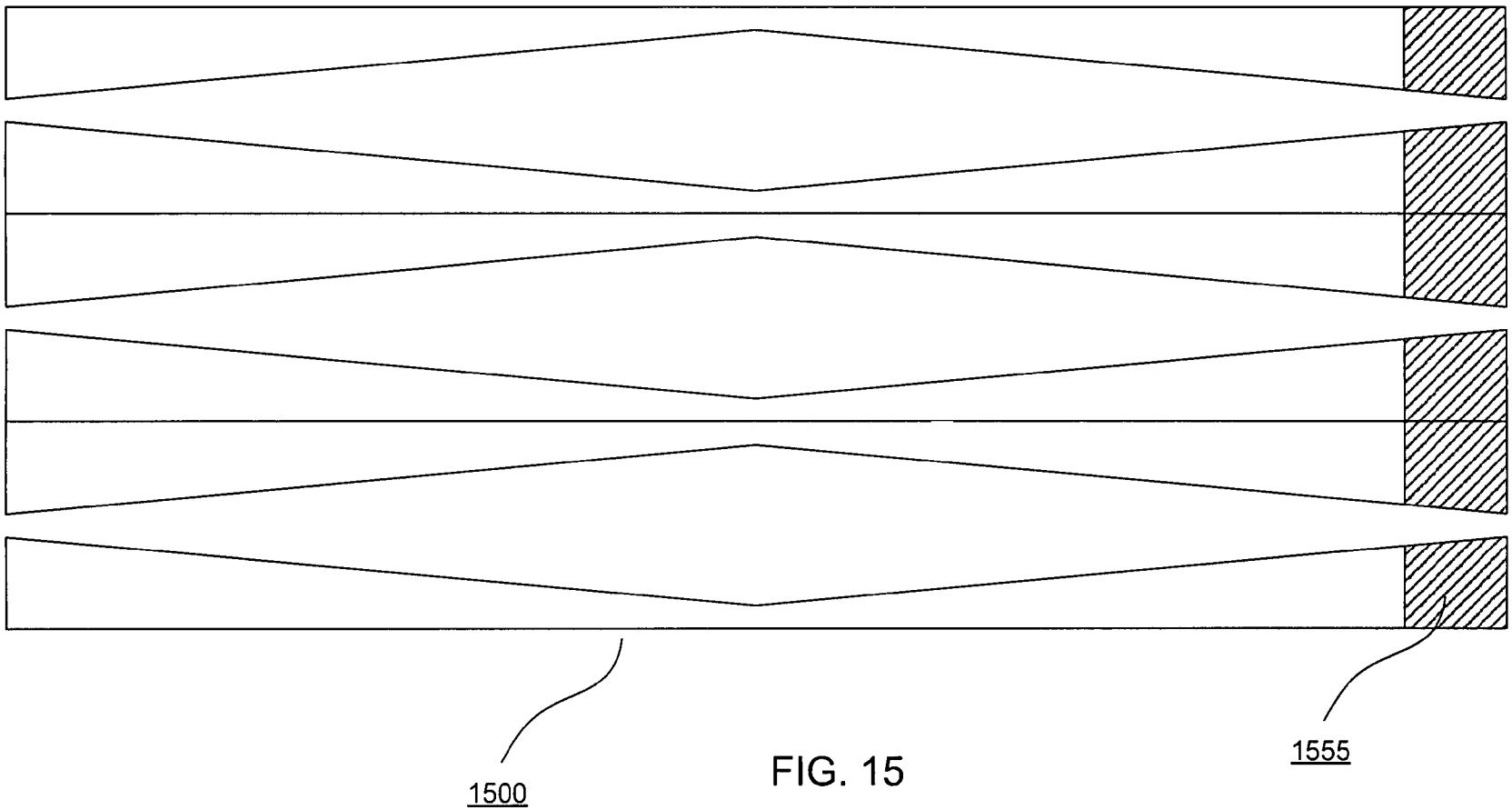
FIG. 15 depicts an embodiment consistent with the present invention utilizing a parallel configuration of the embodiment consistent with FIG. 7.

FIG. 15 depicts a view of another exemplary embodiment consistent with the present invention. Micro channel 1500, consistent with an embodiment of the present invention, is configured to utilize a parallel combination of the exemplary embodiment depicted in FIG. 7. Accordingly, the discussion relevant to the embodiment depicted in FIG. 7 is herein incorporated by reference. In the embodiment depicted in FIG. 15, portions of micro channel 1500 may be thermally isolated from other portions, designated in FIG. 15 as region 1555.

Figure 16:
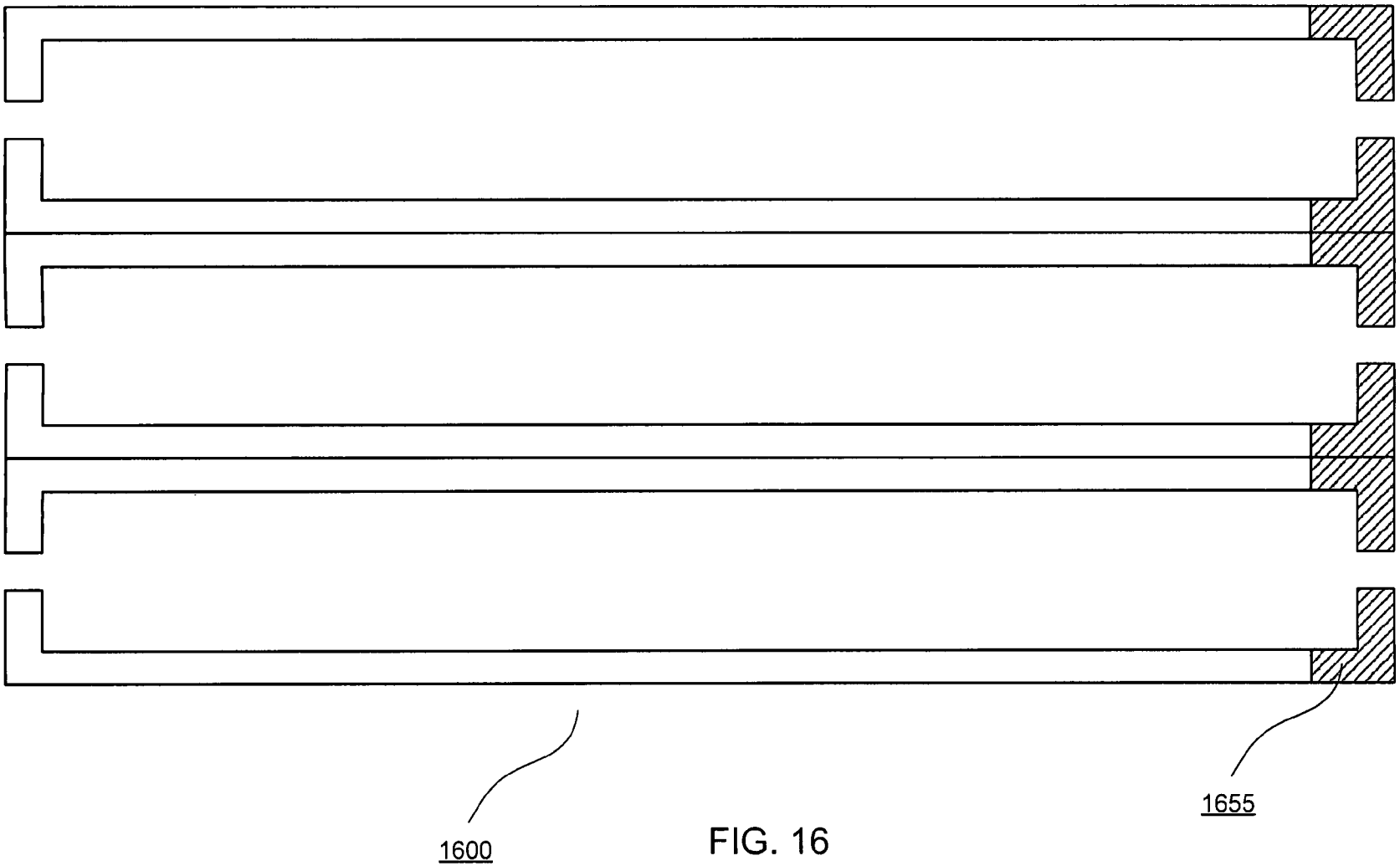
FIG. 16 depicts an embodiment consistent with the present invention utilizing a parallel configuration of the embodiment consistent with FIG. 8.

FIG. 16 depicts a view of another exemplary embodiment consistent with the present invention. Micro channel 1600, consistent with an embodiment of the present invention, is configured to utilize a parallel combination of the exemplary embodiment depicted in FIG. 8. Accordingly, the discussion relevant to the embodiment depicted in FIG. 8 is herein incorporated by reference. In the embodiment depicted in FIG. 16, portions of micro channel 1600 may be thermally isolated from other portions, designated in FIG. 16 as region 1655.

Figure 17:
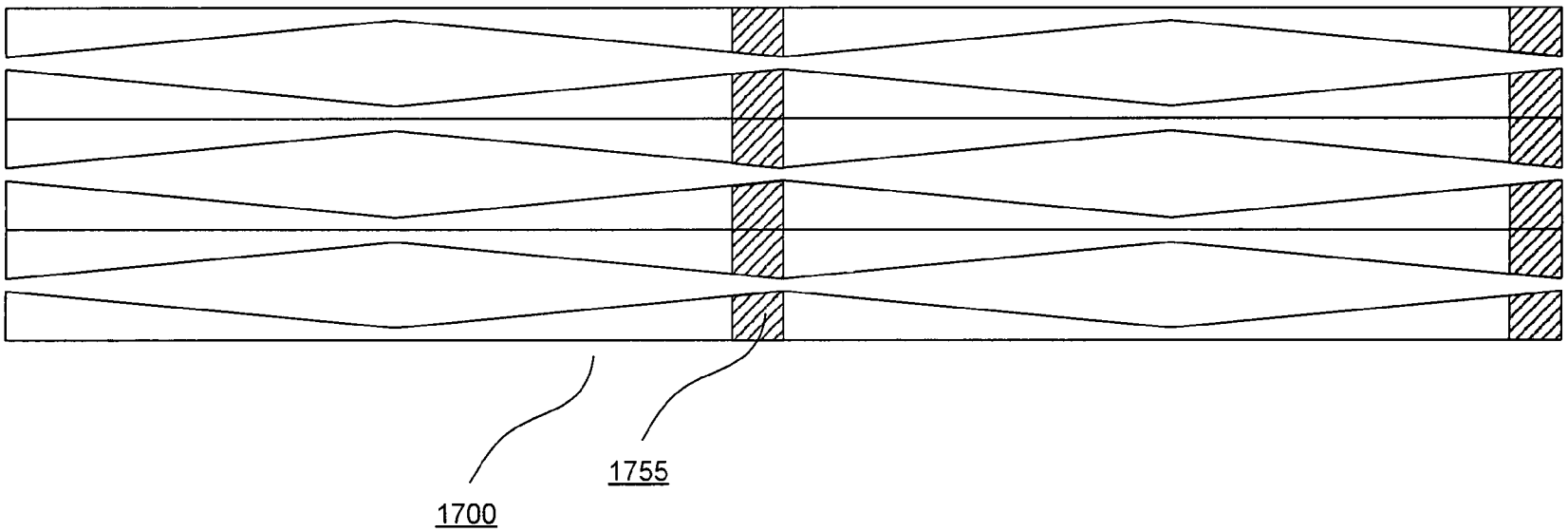
FIG. 17 depicts an embodiment consistent with the present invention utilizing a parallel configuration of the embodiment consistent with FIG. 9.

FIG. 17 depicts a view of another exemplary embodiment consistent with the present invention. Micro channel 1700, consistent with an embodiment of the present invention, is configured to utilize a parallel combination of the exemplary embodiment depicted in FIG. 9. Accordingly, the discussion relevant to the embodiment depicted in FIG. 9 is herein incorporated by reference. In the embodiment depicted in FIG. 17, portions of micro channel 1700 may be thermally isolated from other portions, designated in FIG. 17 as region 1755.

Figure 18:
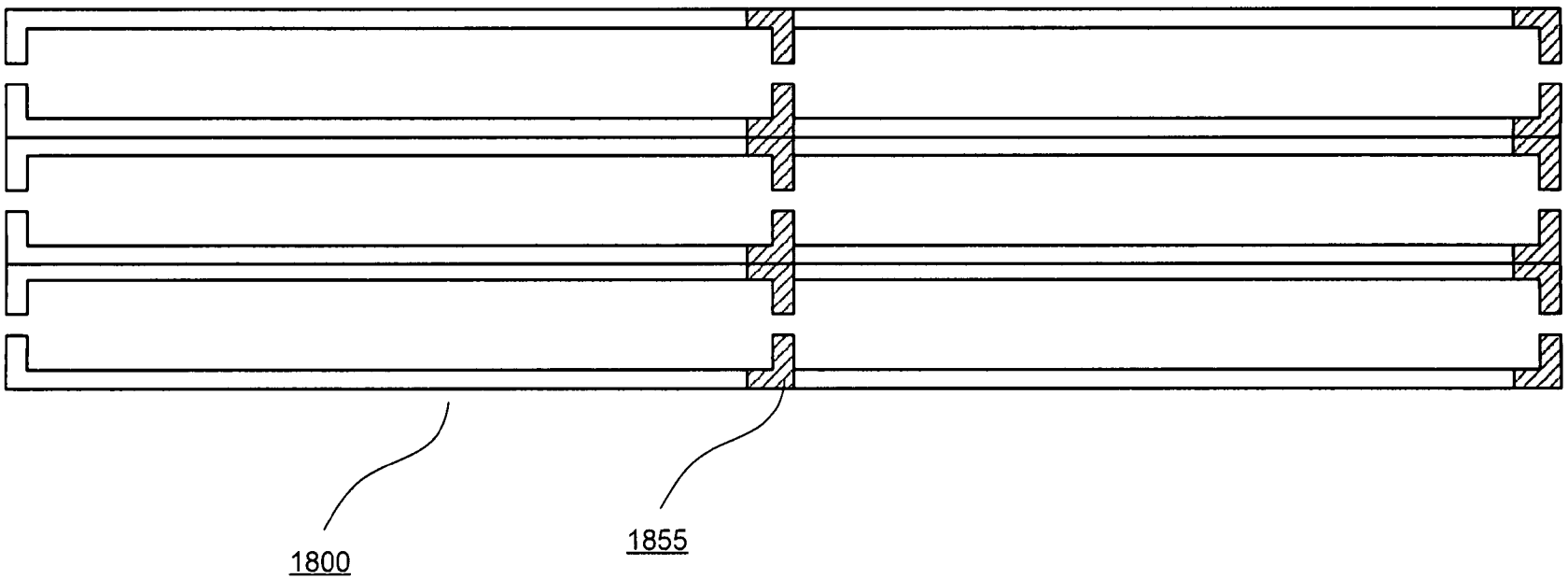
FIG. 18 depicts an embodiment consistent with the present invention utilizing a parallel configuration of the embodiment consistent with FIG. 10.

FIG. 18 depicts a view of another exemplary embodiment consistent with the present invention. Micro channel 1800, consistent with an embodiment of the present invention, is configured to utilize a parallel combination of the exemplary embodiment depicted in FIG. 10. Accordingly, the discussion relevant to the embodiment depicted in FIG. 10 is herein incorporated by reference. In the embodiment depicted in FIG. 18, portions of micro channel 1800 may be thermally isolated from other portions, designated in FIG. 18 as region 1855.

Summary of Experimental Results

We have made measurements on a device consistent with the present invention. The device is a 30×30×1 millimeter MEMS device is configured with 100 parallel micro channels. Each micro channel consists of a inflow opening with throat that narrows to approximately 10×10 micrometers. The throat opens to a source gas (air), and has a cross section that is small to restrict the mass flow of the gas. The throat portion is also short (in the direction of flow) to allow for sonic speed gas flow. The distance between the inflow opening and the outflow opening is approximately 30 mm. It is configured to allow for a large number of collisions between the molecules entering the micro channel from the source gas and the walls of the micro channel.

The wall portion of each channel proximal to the flow of gas is made of a hard, dense, high-melting point material. In the device used for measurements, tungsten was used. The tungsten was deposited using MEMS fabrication methods in order to make the surface generally smooth. While the micro channel walls of the device comprised tungsten, the remaining material behind the tungsten (selected to allow for low thermal resistance) comprised copper. In the device used for measurements, the micro channels and the walls were generated in the following manner. A layer of tungsten was sputtered onto a layer of silicon that is provided on a conventional wafer (such as those with a single-side polish). A photomask is then applied to the tungsten layer in order to form a photoresist layer comprising a series of raised channels. The dimensions of each raised channel correspond to that of the desired micro channel. Tungsten was then deposited using sputtering techniques onto the wafer comprising the silicon substrate, the layer of tungsten, and the layer of photoresist channels. Copper was then sputtered over the layer of tungsten, and then a further layer of copper was electroplated over the sputtered layer of copper. After the wafer is cut to the desired dimension (in this instance a 30×30 mm square), the photoresist is then removed using an acetone ultrasonic bath. In the sequence provided above, one may use a copper substrate rather than a silicon substrate in order to improve the thermal conductive properties of the device.

Consistent with the present invention, the geometric profile and materials used to construct the throat at the inflow opening and the surface of the walls of the micro channel device were selected for both the specular interaction between air molecules and a relatively smooth tungsten surface, and to convert certain of the internal thermal energy of the air and the thermal energy of the micro channel into flow velocity of the air passing through the micro channel.

Collisions between gas molecules and surfaces of different materials (e.g. gold, copper, silicon, tungsten, lead) have been shown to be specular.

The material surrounding the micro channels (i.e., copper in the measured device) was selected to provide good thermal transport between the ambient air and the surface of the micro channel and throat. Generally, desirable materials would include those with a high coefficient of thermal conduction and that provide structural integrity for the device in both atmospheric and low-pressure environments.

As presently understood, the efficiency of a device consistent with the present invention for cooling may depend on the properties of the surface over which the fluid moves and collides with. For example, a preferred surface consistent with the present is a surface that is relatively smooth, so that the collisions between the constituent particles of the fluid and the walls may be expected to have a minimal effect on the internal velocity of the constituent particles of the fluid in the direction of flow. With such an understanding, the more "mirror-like" the wall of the micro channel is to the collision of incident constituent particles in the fluid, the better the chance for the transfer of thermal energy from the micro channel to the fluid or vice versa.

It is believed that the specularity of a wall of micro channel may be influenced by its material composition. For example, where the fluid is a gas, it is suggested that the degree to which gas-surface collisions result in specular reflection increases when micro channels are composed of very hard materials with high melting points such as tungsten or diamond. Accordingly, when a high thermal transfer rate between the fluid and the micro channel is sought, it is suggested that materials with a high thermal conductivity may be used for the material just behind the walls of the micro channel surface, and any surrounding structures.

Accordingly, it is suggested that the rate that energy is extracted from the ambient to the gas flow is proportional to the rate at which thermal transferring surface collisions occur. It is further suggested that this rate can be increased in the micro channels by maximizing the surface area that is exposed to the flowing gas. Consequently, MEMS micro channels inherently provide a high area to flow volume ratio and can be fabricated with macroscopic lengths with existing fabrication methods.

Moreover, it is suggested that the efficiency of the device is proportional to the effective temperature difference between the fluid and the wall of the micro channel. The effective temperature of the fluid is lower when more of the initial kinetic energy of the fluid is used for flow of the fluid through the micro channel. As kinetic energy varies with the square of velocity, it is suggested that this temperature difference is proportional to the square of the flow velocity of the fluid through the channel. In other words a linear increase in flow velocity results in a greater than linear increase in the quantity of energy extracted per collision.

One mechanism that may be used to achieve sonic axial velocity of the flow at the device input is to design the throat as an orifice or with orifice-like geometry. Flow velocities through the throat of an orifice or a high-velocity nozzle are known in the art to be sonic as long as the pressure ratio between the high pressure and low pressure ends of the micro channels remains below a critical value, which for air is 0.528.

At room temperature, gas molecules (such as air) have a speed of about 500 m/s and temperature (about 300K) that is proportional to the square of the speed. When the gas is induced to flow at sonic speed or 340 m/s, the effective temperature, assuming perfect specular reflection, is reduced to:

$$300K-300K*((340\ m/s*340\ m/s)/(500\ m/s*500\ m/s)) =162K.$$

It is evident from the calculation that sonic velocity gas provides a sufficiently low effective temperature to achieve energy extraction from the micro channel walls of a device in air at room temperature.

Another advantage of a sonic flow entry velocity is that many conventional displacement pumps operate very efficiently at this pressure ratio.

The rates of energy extraction afforded by sonic velocity flow have been surpassed, however, because of the sustained process of intermolecular collisions and asymmetric collision rates. The collision processes continuously convert a portion of the random kinetic energy of the fluid into motion in the direction of flow over the length of the micro channels. While such a velocity starts at sonic speed, it increases to supersonic speeds as energy is continuously transferred from the micro channel surfaces, into the colliding gas molecules, and then into the velocity of the flow along the micro channel. This continuous energy conversion process significantly increases the quantity of energy removed by each gas molecule. We have calculated exit velocities of 2000 m/s with entry velocities as low as 4 m/s in 3 cm length devices. The average kinetic energy that was extracted from the ambient by each molecule was approximately eleven times the starting kinetic energy level of the gas molecule. This quantity of extracted energy is approximately 3 times as much energy as that absorbed by the average evaporating refrigerant molecule in a typical compression refrigeration system.

The most efficient energy extraction devices will provide a high rate of intermolecular collisions and a sustained asymmetry of collision rates, all the way through the device. One method of achieving this combination of conditions is to use divergent micro channel architecture: that is, one where the flow cross section grows from the throat of a micro channel at its inflow opening to its exit at the outflow opening. The rate of change of the channel cross section depends on the gas composition, the heat transfer rate along the micro channel surface, the degree to which surface collisions are specular, and the axial flow velocity at each point along the length of the micro channel.

Another benefit of divergent micro channel geometry is that gas density drops gradually to increasingly lower densities over the length of the micro channel surfaces. Reduced gas densities attenuate boundary effects and improve the energy transfer per collision. Boundary layer attenuation along the micro channel surfaces, or device stator, is evidenced by the significant reduction of surface temperature in an operating device.

The demonstrated energy extraction from room air and the commensurate reduction in device surface temperature has been calculated as 4,130 times the reduction that could be attributed to the Joule-Thomson effect with the same 1 atmosphere pressure drop experienced along the device micro channels.

Acceleration of air molecules from 4 m/s to over 2,000 m/s in a MEMS device with a plurality of 30 mm long micro channels arranged in parallel has been demonstrated in the measured device. The temperature of the air supply was 296K. The temperature of the air at the exhaust was approximately 2,000 m/s. The average molecule experienced a net kinetic energy increase of eleven times its initial value over its 30 mm travel down the micro channel. The energy of acceleration can be removed from the accelerated molecules without any net reduction in mass flow at the entrance of the device.

It is well known that coherent and non-coherent light emission in a gas occurs with a quantum reduction in vibrational kinetic energy of an atom or molecule. It is a prerequisite that the gas atom or molecule be at a specified vibrational energy level prior to the reduction to achieve photonic emission. One method of achieving a prerequisite vibrational energy level is to accelerate an atom or molecule to a sufficiently high velocity and then subject the particle to a collision. The collision converts some portion of the atom's translational energy to the desired high vibrational energy state. The remaining portion of the energy in the translational mode allows the atom to continue in a flow condition where the collision frequency is sufficiently low to allow the vibrational mode to reach its relaxation point and emit a photon. Carbon dioxide gas in a CO2 laser is commonly increased to 500K in a Maxwell-Boltzmann distribution in order to achieve the high vibrational energy requirement for emission. The gas is then allowed to relax to create conditions for emission.

The energy extraction device has demonstrated the ability to increase the average room air molecule from a temperature of 300K to over 4000K, more than is required to achieve emission for many gas species.

One such design consistent with the present invention achieves the desired translational and vibrational energy levels by an initial reduction in the flow cross-section, to increase intermolecular collision frequency hence vibrational energy followed by a reduction in the flow cross section to reduce intermolecular collision frequency, allow for quantum relaxation that results in subsequent photonic emission.

The energy of acceleration may also be harvested by thermoelectric means. Accelerated gas molecules with an angle of attack of less than 45 degrees relative to surface normal have been demonstrated to raise surface temperature. Thermoelectric devices with a thermal path to such heated surfaces can be used to extract the energy of acceleration and convert the heat to electricity.

Similarly, reductions and increases of cross flow cross sections can be used to provide reaction energies for gasses. Chemical reactions between gasses in flow and gaseous and or non-gaseous materials within microchannels can be achieved by acceleration of the gas with the device and varying the energy modes with increases and decreases to flow cross section area.

Energies sufficient for photon emission and plasma formation have also been demonstrated. Photonic emission can also be facilitated by the use of gas mixtures that include components whose molecular structure allows for emission at the desired energy levels and wavelengths.

The transfer of energy from the micro channel walls to the flow results in a reduction in temperature of the micro channel surface and the surrounding material. This cooling effect allows the device to be used for the purpose of refrigeration. We have demonstrated micro channel gas flow effective temperatures well below 100 K with 296 K room air as the source gas in supersonic flow within the micro channels.

A high-energy flow within the micro channels of an energy extraction device has been demonstrated to produce flash evaporation of a liquid for an additional cooling effect. The high speed gas flow over the liquid surface provides a radically reduced perpendicular pressure which causes rapid evaporation.

Energy extraction increases at a greater than linear rate with flow acceleration. Likewise, a gas flow will continue to accelerate as additional energy is extracted from the ambient into the gas.

Acceleration of a gas flow through a plurality of serially connected microchannel arrays has been demonstrated by a MEMS device. As a result, gases may be transported at sonic velocities over a distance without suffering any net loss in velocity due to friction. Such a configuration would consist of a single pump with sufficient capacity to create the requisite low pressure condition on the downstream end with the low rate equal to that of the mass flow rate of the orifice at the entrance of the micro channel series. The advantage over prior art being that there is no need for additional pumps to be placed within the series to counteract frictional losses. In addition, the energy of acceleration may be harvested all along the length of the micro channel device length for conversion into electricity.

Surfaces that are used to extract energy from a gas flow as heat can be used as a means to heat another gas, liquid or solid that is in thermal contact with the collision surface. Collision surfaces can be designed to only remove the previous energy of acceleration from the gas flow. The flow energy that remains allows for the continuation of the flow at sonic velocity or above.

Materials and components consistent with the present invention, such as the exemplary device described above, offers solutions to all of the problems that have been identified Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An apparatus for cooling comprising:

a micro channel comprising a wall portion, an inflow opening, and an outflow opening; and a gas comprising a constituent particle;

wherein the micro channel is configured to accommodate a flow of the gas from the inflow opening to the outflow opening in a first direction substantially perpendicular to a cross section of the micro channel;

wherein the inflow opening has a first cross section area and the outflow opening has a second cross section area substantially different from the first cross section area;

wherein the wall portion and the constituent particle are configured such that collisions between the constituent particle and the wall portion are substantially specular;

wherein the first cross section has a value in a first range of about 0.01 $\mu m^2$ to 500 $\mu m^2$;

wherein the second cross section has a value in a second range of about 0.1 $\mu m^2$ to 50,000 $\mu m^2$;

wherein at least a portion of the cross section of the micro channel varies as a function of a length in the first direction between the inflow opening and the outflow opening; and wherein the variation in the cross section of the micro channel as a function of a length in the first direction between the inflow opening and the outflow opening is substantially linear and substantially increasing.

2. The apparatus of claim 1 wherein the gas comprises air.

3. The apparatus of claim 1 wherein the particle is selected from at least one of a set consisting of: a molecule and an atom.

4. The apparatus of claim 1 wherein the wall portion comprises a material deposited using sputtering.

5. The apparatus of claim 1 wherein the wall portion comprises a material with a high melting point.

6. The apparatus of claim 1 wherein the wall portion comprises a material with a high density.

7. The apparatus of claim 1 wherein the wall portion further comprises a coating material.

8. The apparatus of claim 1 wherein the wall portion comprises a coating material deposited on a substrate material using sputtering, and wherein the substantially specular collision between the constituent particle and the wall portion comprise a substantially specular collision between the constituent particle and the coating material.

9. The apparatus of claim 8 wherein the substrate material comprises copper.

10. The apparatus of claim 9 wherein the coating material comprises tungsten.

11. The apparatus of claim 1 wherein a linear distance between the inflow opening and the outflow opening along a length of the micro channel has a value in a range of about 0.01 mm to 10 m.

12. An apparatus for cooling comprising:

a micro channel comprising a wall portion, an inflow opening, and an outflow opening; and a gas comprising a constituent particle;

wherein the micro channel is configured to accommodate a flow of the gas from the inflow opening to the outflow opening in a first direction substantially perpendicular to a cross section of the micro channel;

wherein the inflow opening has a first cross section area and the outflow opening has a second cross section area substantially different from the first cross section area;

wherein the wall portion and the constituent particle are configured such that collisions between the constituent particle and the wall portion are substantially specular;

wherein the first cross section has a value in a first range of about 0.01 $\mu m^2$ to 500 $\mu m^2$;

wherein the second cross section has a value in a second range of about 0.1 $\mu m^2$ to 50,000 $\mu m^2$;

wherein at least a portion of the cross section of the micro channel varies as a function of a length in the first direction between the inflow opening and the outflow opening; and wherein the variation in the cross section of the micro channel as a function of a length in the first direction between the inflow opening and the outflow opening is substantially linear and substantially increasing in a first region and substantially linear and substantially decreasing in a second region, wherein the first region is proximal to the inflow opening and the second region is proximal to the outflow opening.

13. The apparatus of claim 12 further comprising, a thermoelectric device proximal to the outflow opening.

14. The apparatus of claim 12 further comprising, a photoelectric device proximal to the outflow opening.

15. The apparatus of claim 12 wherein the wall portion comprises a material deposited using sputtering.

16. The apparatus of claim 12 wherein the wall portion comprises a material with a high melting point.

17. The apparatus of claim 12 wherein the wall portion comprises a material with a high density.

18. The apparatus of claim 12 wherein the wall portion further comprises a coating material.

19. The apparatus of claim 12 wherein the wall portion comprises a coating material deposited on a substrate material using sputtering, and wherein the substantially specular collision between the constituent particle and the wall portion comprise a substantially specular collision between the constituent particle and the coating material.

20. The apparatus of claim 19 wherein the substrate material comprises copper.

21. The apparatus of claim 20 wherein the coating material comprises tungsten.

22. An apparatus for cooling comprising:

a micro channel comprising a wall portion, an inflow opening, and an outflow opening; and a gas comprising a constituent particle;

wherein the micro channel is configured to accommodate a flow of the gas from the inflow opening to the outflow opening in a first direction substantially perpendicular to a cross section of the micro channel;

wherein the inflow opening has a first cross section area and the outflow opening has a second cross section area substantially different from the first cross section area;

wherein the wall portion and the constituent particle are configured such that collisions between the constituent particle and the wall portion are substantially specular;

wherein the first cross section has a value in a first range of about 0.01 $\mu m^2$ to 500 $\mu m^2$;

wherein the second cross section has a value in a second range of about 0.1 $\mu m^2$ to 50,000 $\mu m^2$;

wherein at least a portion of the cross section of the micro channel varies as a function of a length in the first direction between the inflow opening and the outflow opening; and wherein the variation in the cross section of the micro channel as a function of a length in the first direction between the inflow opening and the outflow opening is substantially abrupt in a region proximal to the inflow opening, is substantially abrupt in a region proximal to the outflow opening, and is substantially constant between the region proximal to the inflow opening and the region proximal to the outflow opening, and wherein the cross section of the micro channel between the region proximal to the inflow opening and the region proximal to the outflow opening is greater than the cross section of the micro channel in the region proximal to the inflow opening.

23. The apparatus of claim 22 further comprising, a thermoelectric device proximal to the outflow opening.

24. The apparatus of claim 22 further comprising, a photoelectric device proximal to the outflow opening.

25. A method for cooling, comprising:

providing a micro channel comprising a surface, an inflow opening, and an outflow opening, wherein the surface comprises a wall portion, and wherein the inflow opening has a first cross section area and the outflow opening has a second cross section area substantially different from the first cross section area;

providing a gas comprising a constituent particle;

inducing a flow of the gas from the inflow opening to the outflow opening in a first direction substantially perpendicular to a cross section of the micro channel;

wherein at least one of the wall portion and the constituent particle is configured such that collisions between the constituent particle and the wall portion are substantially specular;

wherein the first cross section has a value in a first range of about 0.01 $\mu m^2$ to 500 $\mu m^2$;

wherein the second cross section has a value in a second range of about 0.1 $\mu m^2$ to 50,000 $\mu m^2$;

wherein at least a portion of the cross section of the micro channel varies as a function of a length in the first direction between the inflow opening and the outflow opening; and wherein the variation in the cross section of the micro channel as a function of a length in the first direction between the inflow opening and the outflow opening is substantially linear and substantially increasing.

26. The method of claim 25 wherein:

a portion of gas proximal to the inflow opening is at a first temperature;

a portion of gas proximal to the outflow opening is at a second temperature;

the constituent particle is a molecule with a set of vibrational states; and the step of providing a gas comprising a constituent particle comprises:

providing a portion of the gas comprising a plurality of the molecules; and wherein the plurality of molecules exhibit a first distribution of vibrational states associated with the first temperature; and the plurality of molecules exhibit a second distribution of vibrational states associated with the second temperature.

27. The method of claim 25 wherein the gas comprises air.

28. The method of claim 25 wherein the particle is selected from at least one of a set consisting of: a molecule and an atom.

29. The method of claim 25 wherein the micro channel further comprises: a material deposited on the surface using sputtering.

30. The method of claim 25 wherein the wall portion comprises a material with a high melting point.

31. The method of claim 25 wherein the wall portion comprises a material with a high density.

32. The method of claim 25 wherein the micro channel further comprises: a coating material deposited on the surface using sputtering.

33. The method of claim 32 wherein the surface comprises copper.

34. The method of claim 33 wherein the coating material comprises tungsten.

35. The method of claim 25 wherein a linear distance between the inflow opening and the outflow opening along a length of the micro channel has a value in a range of about 0.01 mm to 10 m.

36. A method for cooling, comprising:

providing a micro channel comprising a surface, an inflow opening, and an outflow opening, wherein the surface comprises a wall portion, and wherein the inflow opening has a first cross section area and the outflow opening has a second cross section area substantially different from the first cross section area;

providing a gas comprising a constituent particle;

inducing a flow of the gas from the inflow opening to the outflow opening in a first direction substantially perpendicular to a cross section of the micro channel;

wherein at least one of the wall portion and the constituent particle is configured such that collisions between the constituent particle and the wall portion are substantially specular;

wherein the first cross section has a value in a first range of about 0.01 $\mu m^2$ to 500 $\mu m^2$;

wherein the second cross section has a value in a second range of about 0.1 $\mu m^2$ to 50,000 $\mu m^2$;

wherein at least a portion of the cross section of the micro channel varies as a function of a length in the first direction between the inflow opening and the outflow opening; and wherein the variation in the cross section of the micro channel as a function of a length in the first direction between the inflow opening and the outflow opening is substantially linear and substantially increasing in a first region and substantially linear and substantially decreasing in a second region, wherein the first region is proximal to the inflow opening and the second region is proximal to the outflow opening.

37. The method of claim 36 further comprising, providing a thermoelectric device proximal to the outflow opening.

38. The method of claim 36 further comprising, providing a photoelectric device proximal to the outflow opening.

39. The method of claim 36 wherein the micro channel further comprises: a material deposited on the surface using sputtering.

40. The method of claim 36 wherein the wall portion comprises a material with a high melting point.

41. The method of claim 36 wherein the wall portion comprises a material with a high density.

42. The method of claim 36 wherein the micro channel further comprises: a coating material deposited on the surface using sputtering.

43. The method of claim 42 wherein the surface comprises copper.

44. The method of claim 43 wherein the coating material comprises tungsten.

45. A method for cooling, comprising:

providing a micro channel comprising a surface, an inflow opening, and an outflow opening, wherein the surface comprises a wall portion, and wherein the inflow opening has a first cross section area and the outflow opening has a second cross section area substantially different from the first cross section area;

providing a gas comprising a constituent particle;

inducing a flow of the gas from the inflow opening to the outflow opening in a first direction substantially perpendicular to a cross section of the micro channel;

wherein at least one of the wall portion and the constituent particle is configured such that collisions between the constituent particle and the wall portion are substantially specular;

wherein the first cross section has a value in a first range of about 0.01 $\mu m^2$ to 500 $\mu m^2$;

wherein the second cross section has a value in a second range of about 0.1 $\mu m^2$ to 50,000 $\mu m^2$;

wherein at least a portion of the cross section of the micro channel varies as a function of a length in the first direction between the inflow opening and the outflow opening; and wherein the variation in the cross section of the micro channel as a function of a length in the first direction between the inflow opening and the outflow opening is substantially abrupt in a region proximal to the inflow opening, is substantially abrupt in a region proximal to the outflow opening, and is substantially constant between the region proximal to the inflow opening and the region proximal to the outflow opening, and wherein the cross section of the micro channel between the region proximal to the inflow opening and the region proximal to the outflow opening is greater than the cross section of the micro channel in the region proximal to the inflow opening.

46. The method of claim 45 further comprising, providing a thermoelectric device proximal to the outflow opening.

47. The method of claim 45 further comprising, providing a photoelectric device proximal to the outflow opening.

48. A system for cooling comprising:

a micro channel comprising a wall portion, an inflow opening, and an outflow opening; and a gas comprising a constituent particle, the gas being induced to flow through the micro channel through operation of a pressure differential between a first pressure and a second pressure, the first pressure of the gas proximal to the inflow opening being atmospheric and the second pressure of the gas proximal to the outflow opening being substantially less than atmospheric;

wherein the micro channel is configured to accommodate a flow of the gas from the inflow opening to the outflow opening in a first direction substantially perpendicular to a cross section of the micro channel;

wherein the wall portion and the constituent particle are configured such that collisions between the constituent particle and the wall portion are substantially specular;

wherein the inflow opening has an inflow cross section value in a first range of about 0.01 $\mu m^2$ to 500 $\mu m^2$; and wherein the outflow opening has an outflow cross section value in a second range of about 0.1 $\mu m^2$ to 50,000 $\mu m^2$.

49. The system of claim 48 wherein the gas comprises air.

50. The system of claim 48 wherein a linear distance between the inflow opening and the outflow opening along a length of the micro channel has a value in a range of about 0.01 mm to 10 m.

51. A method for cooling, comprising:

providing a micro channel comprising a surface, an inflow opening, and an outflow opening, wherein the surface comprises a wall portion;

providing a gas comprising a constituent particle;

inducing a flow of the gas from the inflow opening to the outflow opening in a first direction substantially perpendicular to a cross section of the micro channel through operation of a pressure differential between a first pressure and a second pressure, the first pressure of the gas proximal to the inflow opening being atmospheric and the second pressure of the gas proximal to the outflow opening being substantially less than atmospheric;

wherein at least one of the wall portion and the constituent particle is configured such that collisions between the constituent particle and the wall portion are substantially specular;

wherein the inflow opening has an inflow cross section value in a first range of about 0.01 $\mu m^2$ to 500 $\mu m^2$; and wherein the outflow opening has an outflow cross section value in a second range of about 0.1 $\mu m^2$ to 50,000 $\mu m^2$.

52. The method of claim 51 wherein the gas comprises air.

53. The method of claim 51 wherein a linear distance between the inflow opening and the outflow opening along a length of the micro channel has a value in a range of about 0.01 mm to 10 m.

* * * * *